US011203725B2

(12) United States Patent
Lansell et al.

(10) Patent No.: US 11,203,725 B2
(45) Date of Patent: Dec. 21, 2021

(54) SYSTEMS AND METHODS FOR GASIFICATION OF CARBONACEOUS MATERIALS

(71) Applicant: LLT International (Ireland) Ltd., Dublin (IE)

(72) Inventors: Peter Lansell, Kew (AU); David Lowe, Alphington (AU)

(73) Assignee: LLT INTERNATIONAL (IRELAND) LTD., Dublin (IE)

( * ) Notice: Subject to any disclaimer, the term of this patent is extended or adjusted under 35 U.S.C. 154(b) by 77 days.

(21) Appl. No.: 15/481,416

(22) Filed: Apr. 6, 2017

(65) Prior Publication Data

US 2018/0291292 A1 Oct. 11, 2018

(51) Int. Cl.
*C10J 3/48* (2006.01)
*C10J 3/50* (2006.01)
(Continued)

(52) U.S. Cl.
CPC ..... *C10J 3/487* (2013.01); *C10J 3/506* (2013.01); *C10J 3/72* (2013.01); *C10J 3/723* (2013.01);
(Continued)

(58) Field of Classification Search
CPC ..... B01J 19/088; B01J 19/126; B01J 19/129; B01J 19/2405; B01J 2219/089;
(Continued)

(56) References Cited

U.S. PATENT DOCUMENTS 2,257,907 A 10/1941 Griswold
2,532,554 A 12/1950 Joeck
(Continued)

FOREIGN PATENT DOCUMENTS

DE 102013019949 5/2015
EA 000004 9/1997
(Continued)

OTHER PUBLICATIONS

Demare, D., et al., "Acoustic enhancement of combustion in lifted non-remixed jet flames", The Combusion Institute, 139 (2004), 312-328, Elsevier, Inc.
(Continued)

*Primary Examiner* — Anthony J Zimmer
*Assistant Examiner* — Syed T Iqbal
(74) *Attorney, Agent, or Firm* — Pillsbury Winthrop Shaw Pittman LLP

(57) ABSTRACT

Carbonaceous-containing material including biomass, municipal solid waste, and/or coal and/or contaminated soil, and/or other carbonaceous materials may be gasified at low temperatures utilizing a reactor designed to generate shock-waves in a supersonic gaseous vortex. Preprocessed waste may be introduced into the reactor. A gas stream may be introduced substantially tangentially to an inner surface of a chamber of the reactor to generate a gaseous vortex rotating about a longitudinal axis within the chamber. The gas stream may be introduced using a nozzle that accelerates the gas stream to a supersonic velocity, and may impinge on an impactor positioned within the reactor chamber. A frequency of shockwaves emitted from the nozzle into the gaseous vortex may be controlled. The processed waste discharged from the reactor, which may include a gas component and at least a solid component, can be subjected to separation, and at least some of the gas component and at least one solid component (i.e., tars) may be fed back to the feeding device so that the solids from the processed waste condense on preprocessed waste contained in the feeding device and are reprocessed within the reactor. The gas component from the feeding device may be cleaned after the solids have been condensed out in the feeding device.

29 Claims, 9 Drawing Sheets

(51) Int. Cl.

| | |
|---|---|
| ***C10J 3/72*** | (2006.01) |
| ***C10J 3/84*** | (2006.01) |
| ***C10K 1/02*** | (2006.01) |
| ***C10K 1/00*** | (2006.01) |

(52) U.S. Cl.
CPC ..... *C10J 3/84* (2013.01); *C10K 1/002* (2013.01); *C10K 1/02* (2013.01); *C10J 2300/0906* (2013.01); *C10J 2300/0946* (2013.01); *C10J 2300/1807* (2013.01); *C10J 2300/1823* (2013.01)

(58) Field of Classification Search
CPC ..... B01J 2219/0892; B01J 2219/0894; B23K 10/00; C01B 2203/0238; C01B 2203/0272; C01B 2203/0861; C01B 17/046; C01B 17/58; C01B 3/22; C01B 3/24; C01B 3/342; C01F 11/18; C01F 11/24; C01F 11/46; C01F 7/066; C04B 18/04; C04B 7/4453; C10B 23/00; C10J 2200/09; C10J 2300/093; C10J 2300/0943; C10J 2300/0946; C10J 2300/0956; C10J 2300/0959; C10J 2300/0969; C10J 2300/0973; C10J 2300/0983; C10J 2300/123; C10J 2300/1238; C10J 3/54; C10J 3/56; C22B 4/005; D21C 11/12; H01J 37/32009; H05H 1/42; H05H 1/44; Y02E 50/32; Y02P 40/121; Y02P 40/18; Y02P 40/44; Y10S 588/90
See application file for complete search history.

(56) References Cited

U.S. PATENT DOCUMENTS

| | | | | |
|---|---|---|---|---|
| 2,752,097 | A | 6/1956 | Lecher | |
| 3,178,121 | A | 4/1965 | Wallace, Jr. | |
| 3,254,848 | A | 6/1966 | Stephanoff | |
| 3,257,080 | A | 6/1966 | Snyder | |
| 3,301,292 | A | 1/1967 | O'Connor | |
| 2,997,245 | A | 8/1967 | Nilsson et al. | |
| 3,409,419 | A * | 11/1968 | Yates | C04B 35/117 419/13 |
| 3,462,086 | A | 8/1969 | Bertrand et al. | |
| 3,565,348 | A | 2/1971 | Dickerson et al. | |
| 3,602,439 | A | 8/1971 | Nakayama | |
| 3,908,904 | A | 9/1975 | Kerner et al. | |
| 4,198,004 | A | 4/1980 | Albus et al. | |
| 4,248,387 | A | 2/1981 | Andrews | |
| 4,354,641 | A | 10/1982 | Smith | |
| 4,515,093 | A | 5/1985 | Beardmore et al. | |
| 4,671,192 | A | 6/1987 | Hoffert et al. | |
| 4,919,853 | A | 4/1990 | Alvarez et al. | |
| 4,921,173 | A | 5/1990 | Bartley | |
| 5,219,530 | A | 6/1993 | Hertzberg et al. | |
| 5,246,575 | A | 9/1993 | Alexander | |
| 5,277,369 | A | 1/1994 | Moriya et al. | |
| 5,306,330 | A | 4/1994 | Nasikas | |
| 5,855,326 | A | 1/1999 | Beliavsky | |
| 6,089,026 | A | 7/2000 | Hu | |
| 6,145,765 | A | 11/2000 | Capelle, Jr. et al. | |
| 6,152,158 | A | 11/2000 | Hu | |
| 6,158,676 | A | 12/2000 | Hughes | |
| 6,167,323 | A | 12/2000 | Komino et al. | |
| 6,824,086 | B1 | 11/2004 | Mazurkiewicz et al. | |
| 7,137,580 | B2 | 11/2006 | Graham et al. | |
| 7,398,934 | B1 | 7/2008 | Capelle, Jr. | |
| 7,621,473 | B2 | 11/2009 | Capelle, Jr. | |
| 7,789,331 | B2 | 9/2010 | Zehavi et al. | |
| 7,850,105 | B2 | 12/2010 | Ito et al. | |
| 8,172,163 | B2 | 5/2012 | Soliman Abdalla et al. | |
| 8,398,007 | B2 | 3/2013 | Ito et al. | |
| 8,448,518 | B2 | 5/2013 | Kass et al. | |
| 8,480,859 | B2 | 7/2013 | Kostrov et al. | |
| 8,726,532 | B2 | 5/2014 | Hogan | |
| 9,050,604 | B1 | 6/2015 | Lansell et al. | |
| 9,452,434 | B1 | 9/2016 | Lansell et al. | |
| 2003/0024806 | A1 * | 2/2003 | Foret | B01J 19/126 204/164 |
| 2004/0052725 | A1 * | 3/2004 | Niu | B01J 23/63 423/651 |
| 2004/0063874 | A1 | 4/2004 | Muhle et al. | |
| 2004/0200910 | A1 | 10/2004 | Graham et al. | |
| 2007/0267527 | A1 | 11/2007 | Graham et al. | |
| 2008/0226535 | A1 | 9/2008 | Park et al. | |
| 2009/0241816 | A1 | 10/2009 | Taylor | |
| 2010/0025506 | A1 | 2/2010 | Capelle, Jr. | |
| 2010/0101978 | A1 | 4/2010 | Gordon et al. | |
| 2010/0288618 | A1 * | 11/2010 | Feerer | C10B 47/44 202/118 |
| 2011/0206593 | A1 | 8/2011 | Fahs, II et al. | |
| 2011/0283705 | A1 | 11/2011 | Oliver | |
| 2011/0303013 | A1 | 12/2011 | Kass | |
| 2012/0131901 | A1 | 5/2012 | Westervelt et al. | |
| 2012/0230877 | A1 | 9/2012 | Pinchot | |
| 2013/0221141 | A1 | 8/2013 | Zhang et al. | |
| 2013/0315792 | A1 | 11/2013 | O'Dowd | |
| 2013/0336845 | A1 | 12/2013 | Chu | |
| 2014/0058095 | A1 | 2/2014 | Rende et al. | |
| 2014/0058178 | A1 | 2/2014 | Bedard et al. | |
| 2014/0246626 | A1 * | 9/2014 | Ko | C10J 3/84 252/373 |
| 2014/0275687 | A1 | 9/2014 | Beene et al. | |
| 2015/0165414 | A1 | 6/2015 | Gattupalli et al. | |
| 2015/0352558 | A1 | 12/2015 | Keating et al. | |
| 2016/0243488 | A1 | 8/2016 | Wells et al. | |
| 2016/0303539 | A1 | 10/2016 | Lansell et al. | |

FOREIGN PATENT DOCUMENTS

| | | |
|---|---|---|
| FR | 1048667 | 12/1953 |
| GB | 1037770 | 8/1966 |
| RU | 2 029 621 | 2/1995 |
| RU | 2 088 336 | 8/1997 |
| WO | WO 94/08719 | 4/1994 |
| WO | WO 97/33695 | 9/1997 |
| WO | WO 2008/083138 | 7/2008 |

OTHER PUBLICATIONS

Simpson, E., et al., Acoustic Performance of a Cylindrical Disk-Type Resonator, Journal of Sound and Vibration, (1978) 60(1), 151-156, Academic Press Inc. (London) Limited.

Narayanan, S., et al. "Acoustic characteristics of chamfered Hartmann whistles", Journal of Sound and Vibration, 330 (2011) 2470-2496, Elsevier, Ltd.

Narayanan, S. et al., Aero-acoustic features of internal and external chamfered Hartmann whistles: A comparative study, Journal of Sound and Vibration, 333 (2014) 774-787, Elsevier, Ltd.

International Preliminary Report on Patentability and the Written Opinion of the International Searching Authority as issued in International Patent Application No. PCT/US2015/034554, dated Sep. 3, 2015.

Hartmann, J. et al, "Synchronisation of Air-Jet Generators with an Appendix on the Stem Generator", Det Kgl. Danske Videnskabernes Selskab. Matematisk-fysiske Meddelelser, Bd. 26, No. 10, 1951(39 pages).

English machine translation for FR 1048667 A (Dec. 1953).

U.S. Non-Final Office Action dated Jul. 21, 2016 in corresponding U.S. Appl. No. 14/823,890 (13 pages).

International Preliminary Report on Patentability and the Written Opinion of the International Searching Authority as issued in International Patent Application No. PCT/US2015/034548, dated Sep. 8, 2015.

International Search Report and Written Opinion dated Sep. 26, 2016 in corresponding International Patent Application No. PCT/US2016/046641.

(56) References Cited

OTHER PUBLICATIONS

Final Office Action dated Dec. 6, 2016 in corresponding U.S. Appl. No. 14/298,877 (10 pages).
M. Reader-Harris, Orifice Plates and Venturi Tubes, Chapter 3: Venturi Tube Design, 2015, pp. 77-96.
Final Office Action dated Jan. 27, 2017 in corresponding U.S. Appl. No. 14/690,149 (14 pages).
Abstract of DE 102013019949 A1.
Final Office Action dated Dec. 29, 2016 in corresponding U.S. Appl. No. 14/823,890 (14 pages).

* cited by examiner

SYSTEMS AND METHODS FOR GASIFICATION OF CARBONACEOUS MATERIALS

FIELD OF THE DISCLOSURE

This disclosure relates to systems and methods for gasification of carbonaceous materials. More specifically, this disclosure relates to systems and methods for gasification of municipal solid waste and/or biomass and/or coal and/or other carbonaceous materials utilizing a reactor designed to generate shockwaves in a supersonic gaseous vortex.

BACKGROUND

In the United States alone there is approximately 5 billion pounds of construction and demolition lumber waste generated per year. There are 190 million pallets which are consigned to landfill per year. There are many billions of tons of farm and agricultural waste that are either lying fallow on the ground or are being consigned to landfill.

Generally speaking, gasification systems are known that process and convert organic materials into carbon monoxide, hydrogen, carbon dioxide, and/or other gases. However, many challenges exist when scaling small domestic systems up to large industrial and/or municipal systems. Ideally, a scaled-up system should be tolerant of glass, stone, various metals, and/or other contaminants, which are the bane of many existing gasification systems. For example, waste wood (e.g., building rubble) commonly contains nails and nuts and bolts. These common contaminants can eventually block and/or damage most gasification systems. The presence of glass and other ceramic material can also lead to the eventual blockage or damage of the gasification system. In addition, tars and/or other byproducts may build up as a result of localized cold spots within the gasification system that do not allow the material to be heated to the requisite temperature for gasification. The buildup of tars and/or other byproducts may be difficult and labor intensive to remove.

Some conventional gasification systems also may be used to process municipal solid waste. Conventional systems may be designed to cope with a very wide variety of input materials with varying levels of success. Generally speaking, a challenge with municipal solid waste is that it can contain anything from animal carcasses to automotive engine blocks as well as a very wide variety of toxic chemicals like insecticides or herbicides, aerosol cans, liquid petroleum gas (LPG) bottles, and a large percentage of water. In many cases, the high percentage of water may render the waste material nonflammable. Municipal solid waste may contain a large percentage of glass, soil, and/or other material. Such materials may tend to jam or block conventional gasification systems. For example, the wide diversity of thermoset and thermoformed plastics may often cause serious maintenance problems for conventional gasification systems in that they condense out of the exhaust stream in the cooler parts of the gasification systems and present a serious cleaning problem which may require expensive manual labor.

Because most conventional gasification systems run above the slagging temperature of glass and/or ash, operators of these gasification systems may usually have to hand sort the material going into the gasification systems. This may present a very serious occupational hazard for the sorters as well as a very serious problem in retaining those sorters. If the sorters are not extremely diligent, glass may enter conventional gasification systems resulting in possible maintenance issues. There are a number of automated or robotic systems which have been employed for sorting of waste, but to date they are high maintenance and may invariably let through some of the unwanted material.

There are many deposits of low-rank coal, such as Victorian brown coals in Australia, that are considered uneconomical to transport and process due in part to a high percentage of embodied water and/or high sulfur content and/or high ash content. The Victorian brown coals are relatively low in sulfur and ash, but can have up to about 62% of entrained water. Some of the coals also contain low boiling point volatiles that can evaporate during processing or transport, and under certain circumstances, can catch fire.

Gasification of coal and contaminated soil is disclosed in, for example, U.S. Patent Application Publication No. 2015/0352558, the disclosure of which is incorporated herein in its entirety. As described therein, processing of solid materials using the system described may be accomplished using steam as the process gas. Processes of this type may include devolatilizing coal, gasifying coal, decontaminating soil contaminated with hydrocarbons, decontaminating soil contaminated with poly chlorinated biphenyls (PCBs), and/or other processes and/or procedures.

SUMMARY

One aspect of the disclosure relates to a system configured for gasification of carbonaceous materials, preferably at low temperatures, and preferably utilizing a reactor configured to generate shockwaves in a supersonic gaseous vortex. According to exemplary implementations, the system is simple, robust, and tolerant of inhomogeneous contamination, and is applicable to small-scale applications as well as large municipal or industrial applications. Indeed, the presence of foreign material (e.g., glass, stone, bricks, metals, and/or other contaminants) may have very little or no effect on the performance of the system and does not lead to buildups causing maintenance problems, such as corrosion or fouling. As such, the material to be gasified does not require extensive presorting or absolute cleanliness meaning that a very large variety of materials can be processed by the system without grinding and/or sorting that is commonly required in conventional gasification systems.

An aspect of the disclosure relates to a system and method for gasification of carbonaceous materials, such as waste, at low temperatures utilizing a reactor designed to generate shockwaves in a supersonic gaseous vortex. In an embodiment, the system may include a feeding device configured to introduce preprocessed waste into a higher-pressure region from a lower-pressure region. The system also may include a reactor configured to pulverize and gasify preprocessed waste received from the feeding device, the reactor including: (a) a chamber having an internal surface that is substantially axially symmetrical about a longitudinal axis; (b) a material inlet disposed at a first end of the chamber and configured to introduce preprocessed waste into the chamber; (c) a gas inlet disposed proximate to the material inlet and arranged to introduce a gas stream substantially tangentially to the internal surface of the chamber to generate a gaseous vortex rotating about the longitudinal axis within the chamber, the gas inlet comprising a nozzle that accelerates the gas stream to a supersonic velocity, the nozzle being configured to adjustably control a frequency of shockwaves emitted from the nozzle into the gaseous vortex; and (d) an outlet disposed on the longitudinal axis at a second end of the chamber substantially opposite the first end, the outlet configured to discharge processed material from the chamber, the processed material comprising at least a gas component and at least one solid component. The system also may include a gas/solid separator configured to receive the processed material from the reactor and separate the gas component and at least one solid component, and a gas cleanup unit configured to receive the gas component of the processed material, clean the gas component, and output clean gas.

The reactor may be configured such that the input streams impinge on an impactor that may contain a replaceable catalytic surface. The use of catalytic impactors may lead to a reduction in the temperature required for gasification, in some implementations. The use of charged impactors also may lead to improved processing characteristics. The impactor may be insulated from the body of the reactor such that a variable voltage, amperage, frequency, and/or waveform may be applied to the impactor to facilitate desired chemical reactions. This electrical assistance of catalytic activity is generally called Non Faradic Electrochemical Modification of Chemical Activity (NEMCA). NEMCA may reduce the temperature at which a particular chemical reaction takes place, or may reduce the temperature needed to process the solid carbonaceous material.

With the appropriate addition of oxides or hydroxides like sodium hydroxide or calcium oxide or the like, contaminants in carbonaceous materials, such as sulfur and/or chlorine, may be rendered innocuous by the system and method described herein. Conventional gasification systems typically clean up the sulfur dioxide produced when sulfur is a component in the input stream (carbonaceous material, such as waste, municipal waste, biomass, coal, etc.) in a post process gas scrubber. The conditions and the catalytic effect provided by the system and method described herein not only gasify the carbonaceous-containing waste but obviate the need for post processing cleanup. For example, rubber, which is catalyzed with sulfur, can have the sulfur captured by oxides added to the system, with the resulting output being calcium sulfate if limestone were added as the oxide. The system and method also are capable of processing contaminated soil, and has shown to be capable of reducing soil samples contaminated with polyaromatic hydrocarbons (such as polychlorinated biphenyls (PCBs)) from about 300 ppm or more to about 0.4 ppm or less in one pass and at low temperature and pressure.

An additional aspect of the disclosure relates to a system configured for biomass gasification at low temperatures utilizing a reactor designed to generate shockwaves in a supersonic gaseous vortex. Biomass in this instance can refer to the solids that are leftover sewage and have been treated and dried. According to exemplary implementations, the system is simple, robust, tolerant of numerous contaminants, and is applicable to small-scale applications as well as large municipal or industrial applications. The existence of contaminants such as glass, stone, bricks, metals, and/or other material has little or no effect on the performance of the system and does not lead to buildups causing maintenance problems. The biomass therefore does not require extensive presorting or absolute cleanliness prior to processing by the system.

Because of the extreme conditions experienced by the material within a reactor chamber, the system can pulverize and gasify cellulosic type products at relatively low temperatures and pressures. Due to the low temperature, glass may not be softened or melted and may not cause the buildup of slag or sticky material within the chamber. In exemplary implementations, the system may be designed to have low internal wear, with all of the normal wear being taken up by continuously replaceable wear elements. The use of catalytic impactors may lead to a reduction in the temperature required for gasification, in some implementations. The gas produced by exemplary implementations of the system can be very high quality and have a very high calorific value. For example, there may be little nitrogen in the output gas of the system as compared to most conventional gasification systems. The gas may be used in reciprocating engines, gas turbines, and/or in other applications that require high-quality gas.

In accordance with one or more implementations of a system and method for biomass gasification, the system may include a feeding device, a reactor, a gas/solid separator, a gas cleanup unit, and/or other components. The feeding device may be configured to introduce preprocessed biomass into a higher-pressure region from a lower-pressure region. The reactor may be configured to pulverize and gasify preprocessed biomass received from feeding device. The reactor may include a chamber, a material inlet, a gas inlet, an outlet, an impactor (e.g., and NEMCA impactor), and/or other components. The chamber may have an internal surface that is substantially axially symmetrical about a longitudinal axis. The material inlet may be disposed at a first end of the chamber and configured to introduce biomass into the chamber.

The gas inlet may be positioned proximate to the material inlet and arranged to emit a gas stream substantially tangentially to an inner surface of the chamber to produce a gaseous vortex rotating about the longitudinal axis within the chamber. The gas inlet may comprise a nozzle that accelerates the gas stream to a supersonic velocity. The nozzle may be structured to adjustably control a frequency of shockwaves emitted from the nozzle into the gaseous vortex.

The outlet may be positioned on the longitudinal axis at a second end of the chamber opposite from the first end. The outlet may be configured to emit dirty syngas from the chamber. The dirty syngas may include a gas component, tars, and biochar. The gas/solid separator may be configured to receive the dirty syngas from the reactor and separate the gas component and tars from the biochar of the dirty syngas. The gas component and tars may be fed back to the feeding device so that the tars from the syngas condense on preprocessed biomass contained in the feeding device and are reprocessed within the reactor. The gas cleanup unit may be configured to receive the gas component of the syngas from the feeding device after the tars have been condensed out in the feeding device. The gas cleanup unit may be further configured to clean the gas component and output clean gas.

Another aspect of the disclosure relates to a method for biomass gasification at low temperatures utilizing a reactor designed to generate shockwaves in a supersonic gaseous vortex. The method may include introducing preprocessed biomass using a feeding device into a reactor configured to pulverize and gasify preprocessed biomass. The reactor may include a chamber having an internal surface that is substantially axially symmetrical about a longitudinal axis and a material inlet disposed at a first end of the chamber and configured to introduce biomass from the feeding device into the chamber. The method may include introducing a gas stream substantially tangentially to the inner surface of the chamber to effectuate a gaseous vortex rotating about the longitudinal axis within the chamber. The gas stream may be introduced via a gas inlet disposed proximate to the material inlet. The gas inlet may comprise a nozzle that accelerates the gas stream to a supersonic velocity.

The method may include controlling a frequency of shockwaves emitted from the nozzle into the gaseous vortex. The method may include emitting dirty syngas from the chamber of the reactor via an outlet disposed on the longitudinal axis at a second end of the chamber opposite from the first end. The dirty syngas may include a gas component, tars, and biochar. The method may include separating the gas component and tars from the biochar of the dirty syngas using a gas/solid separator. The method may include feeding back the gas component and tars to the feeding device so that the tars from the syngas condense on preprocessed biomass contained in the feeding device and are reprocessed within the reactor. The method may include cleaning the gas component of the syngas from the feeding device after the tars have been condensed out in the feeding device. The method may include outputting clean gas.

Another feature of the disclosure relates to a system configured for gasifying municipal solid waste at low temperatures utilizing a reactor designed to generate shockwaves in a supersonic gaseous vortex. The reactor used to process municipal solid waste may be the same reactor used in the embodiment described previously for processing biomass. According to exemplary implementations, the reactor, because of its inherent design, may be able to cope with a wide variety of input materials with little reduction in efficiency. With a gasification temperature that is below the slagging temperature of the glass and/or ash, there may be no inherent corrosion or fouling of the system. In addition, the vigorous environment inside the reactor may be self-cleaning, resulting in little or no buildup of material, even at higher temperatures.

In accordance with exemplary implementations, as long as material being fed into the reactor is smaller than a threshold size, then the type of material being fed into the reactor may have little or no effect on the performance of the reactor with regard maintenance or wear. In some implementations, the maximum particle size accepted by the reactor may be of the order of 50 mm or 2 inches. However, other sized particles may be suitable for some implementations of the reactor. Inorganic material may be fed into the reactor in preference to organic or plastic material, but this may diminish the rate of gas production in some implementations.

Robotic or hand sorting of the material being fed into the reactor may be significantly reduced because certain embodiments of the reactor are omnivorous (i.e., can accept organic and inorganic materials). This type of sorting can often be one of the most difficult processes for any waste handling system, and typically represents a major part of the labor force and capital investment for the system. Exemplary implementations of the reactor may reduce or eliminate the need for scrupulous sorting, and thereby may do away with most of the labor associated with waste conversion or gasification. Exemplary implementations may also dramatically reduce occupational health and safety issues associated with waste handling systems.

Steam may be used as the oxidizing medium. As such, the output (or product) gas may contain little or no nitrogen due to combustion in air. This may result in a high calorific value gas that is comparable in energy to natural gas. With a simple adjustment to the ratio between carbon monoxide and hydrogen, the output (or product) gas may have the same or higher calorific value as that of natural gas. This may mean that such gas could be plumbed directly into domestic gas systems without a need to convert any of the appliances connected to that system. The steam may be generated in an external boiler or steam generator.

In sum, exemplary implementations may provide one or more of a reduction in preprocessing requirements of municipal solid waste, biomass, coal, and other carbon-containing materials, increased capacity for handling of contamination, high comminution rates increasing gasification efficiency, even temperature distribution, an ability to reprocess condensables from the gas stream, and/or other advantages over conventional systems. It should be noted, however, that for some implementations only some (or none) of the identified advantages may be present and the potential advantages are not necessarily required for all of the implementations.

In accordance with one or more implementations of a system for gasification of municipal solid waste, the system may include a sorting apparatus, a preprocessing unit, a feeding device, a conveying chamber, a reactor, a gas/solid separator, a gas cleanup unit, and/or other components. The sorting apparatus may be configured to facilitate sorting of municipal solid waste to remove metal components from the municipal solid waste. The preprocessing unit may be configured to preprocess the sorted municipal solid waste by reducing a size of individual pieces of the sorted municipal solid waste. The feeding device may be configured to introduce preprocessed municipal solid waste into a higher-pressure region from a lower-pressure region. The conveying chamber may be configured to introduce preprocessed municipal solid waste into a reactor. The conveying chamber may be pressurized with waste gas and/or process gas to a pressure compatible with the reactor.

The reactor may be configured to pulverize and/or gasify preprocessed municipal solid waste received from the conveying chamber. The reactor may include a chamber having an internal surface that is substantially axially symmetrical about a longitudinal axis. The reactor may include a material inlet disposed at a first end of the chamber and configured to introduce municipal solid waste into the chamber. The reactor may include a gas inlet positioned proximate to the material inlet and arranged to emit a gas stream substantially tangentially to an inner surface of the chamber to produce a gaseous vortex rotating about the longitudinal axis within the chamber.

The gas inlet may comprise a nozzle that accelerates the gas stream to a supersonic velocity. The nozzle may be structured to adjustably control a frequency of shockwaves emitted from the nozzle into the gaseous vortex. The nozzle may be positioned to accelerate the input stream to impinge upon an impactor, such as a NEMCA impactor. The reactor may include an outlet disposed on the longitudinal axis at a second end of the chamber opposite from the first end. The outlet may be configured to emit a mixture of product gas and ash from the chamber. The gas/solid separator may be configured to receive the mixture of product gas and ash from the reactor, and separate out the ash from the product gas. The gas cleanup unit may be configured to receive the product gas, clean the product gas, and output clean gas.

Another aspect of the disclosure relates to a method for gasifying municipal solid waste at low temperatures utilizing a reactor designed to generate shockwaves in a supersonic gaseous vortex. The method may include sorting municipal solid waste to remove metal components from the municipal solid waste. The method may include preprocessing the sorted municipal solid waste by reducing a size of individual pieces of the sorted municipal solid waste. The method may include introducing preprocessed municipal solid waste using a feeding device into a conveying chamber pressurized with waste gas or process gas to a pressure compatible with the reactor. The method may include introducing preprocessed municipal solid waste from the conveying chamber into the reactor.

The reactor may be configured to pulverize and gasify preprocessed municipal solid waste. The reactor may include a chamber having an internal surface that is substantially axially symmetrical about a longitudinal axis and a material inlet disposed at a first end of the chamber and configured to introduce municipal solid waste from the feeding device into the chamber. The method may include introducing a gas stream substantially tangentially to the inner surface of the chamber, thereby generating a gaseous vortex rotating about a longitudinal axis within the chamber. The gas stream may be introduced via a gas inlet positioned proximate to the material inlet. The gas inlet may comprise a nozzle that accelerates the gas stream to a supersonic velocity. The method may include controlling a frequency of shockwaves emitted from the nozzle into the gaseous vortex.

The method may further include emitting a mixture of product gas and ash from the chamber of the reactor via an outlet disposed on the longitudinal axis at a second end of the chamber opposite from the first end. The method may include separating out the ash from the product gas using a gas/solid separator. The method may include cleaning the product gas. The method may include outputting clean gas.

These and other features, and characteristics of the embodiments, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1A:
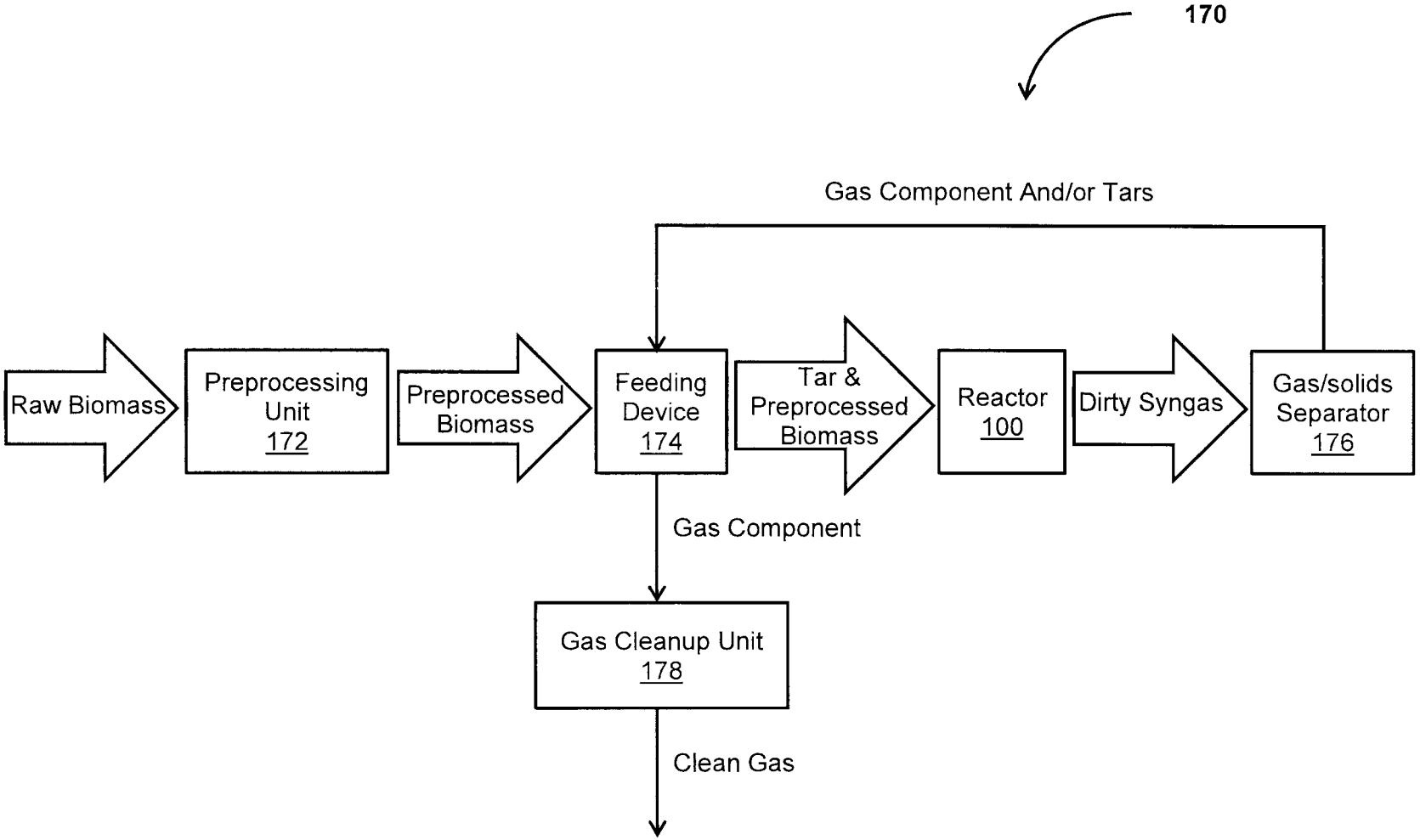
FIG. 1A illustrates a system configured for biomass gasification utilizing a reactor designed to generate shockwaves in a supersonic gaseous vortex, in accordance with one or more implementations.

Throughout this description, like reference numerals refer to like embodiments. The term "reactor" is not intended to denote that a chemical reaction takes place, but rather denotes an apparatus in which materials may be brought together to bring about a change in one or more of the materials, regardless of whether a reaction actually takes place.

FIG. 1A illustrates a system 170 configured for biomass gasification utilizing a reactor 100 designed to generate shockwaves in a supersonic gaseous vortex, in accordance with one or more implementations. In addition to reactor 100, system 170 may include one or more of a preprocessing unit 172, a feeding device 174, a gas/solid separator 176, a gas cleanup unit 178, and/or other components.

The reactor 100 may be configured to pulverize and gasify materials such as biomass. Biomass may include organic material derived from living, or recently living organisms. Biomass may often refer to plants or plant-based materials which are specifically called lignocellulosic biomass. Wood may generally be regarded as the largest biomass energy source. Examples wood-based biomass may include forest residues (e.g., dead trees, branches, tree stumps, and/or other forest residues), yard clippings, wood chips, construction waste, and/or wood-based materials. Industrial biomass may include, or be derived from, numerous types of plants, including *miscanthus*, switchgrass, hemp, corn, poplar, willow, sorghum, sugarcane, bamboo, and a variety of tree species, ranging from *eucalyptus* to oil palm (palm oil). In some implementations, reactor 100 may be configured to receive preprocessed biomass from feeding device 106. Preprocessing unit 104 and feeding device 106 are described further below. In some implementations, the biomass (preprocessed or raw) may be contaminated with one or more of glass, stone, brick, ceramic material, metals, and/or other contaminant materials.

Figure 1B:
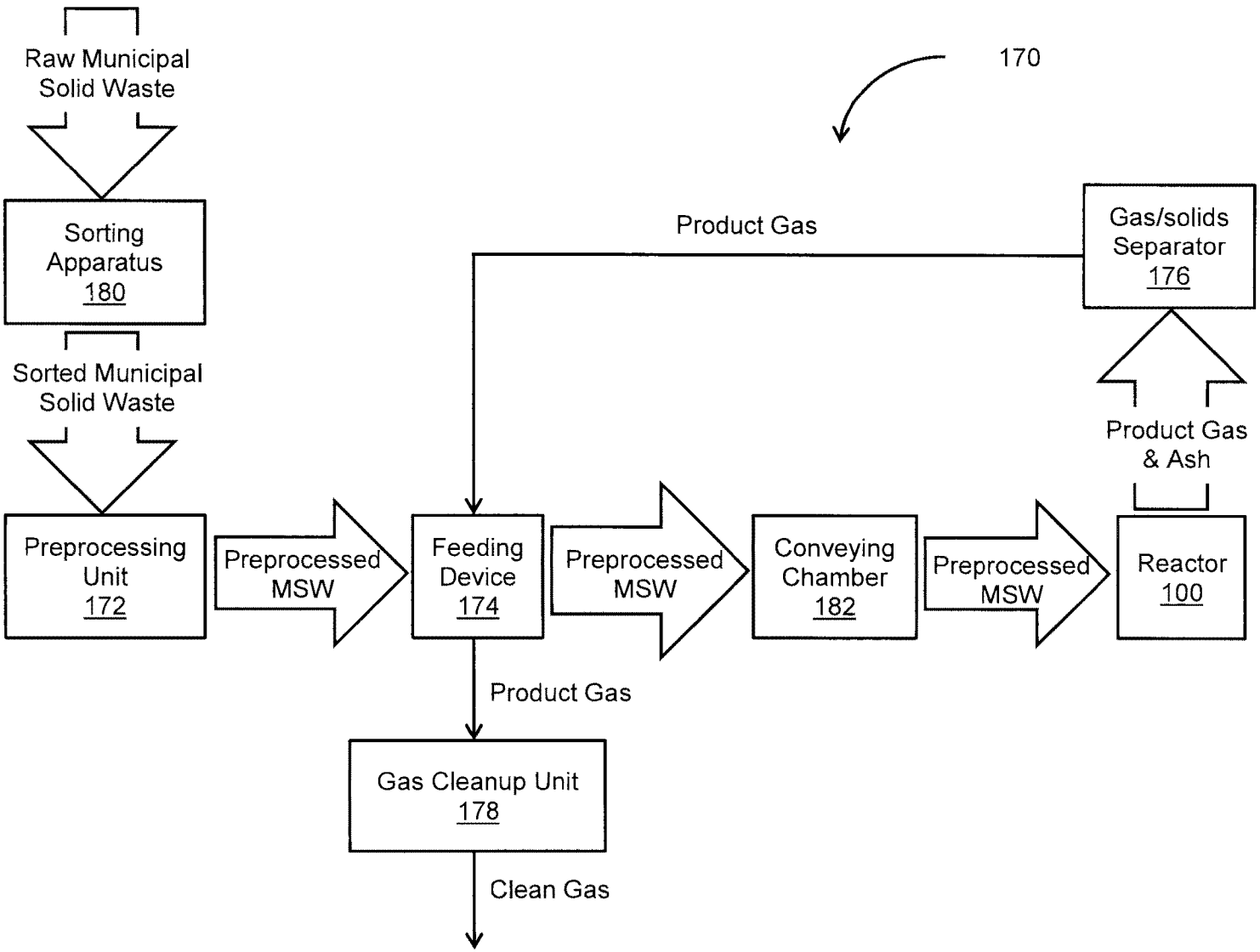
FIG. 1B illustrates a system configured for gasifying municipal solid waste at low temperatures utilizing a reactor designed to generate shockwaves in a supersonic gaseous vortex, in accordance with one or more implementations.

FIG. 1B illustrates another embodiment of system 170 configured for gasifying municipal solid waste at low temperatures utilizing a reactor 100 designed to generate shockwaves in a supersonic gaseous vortex, in accordance with one or more implementations. In addition to reactor 100, system 170 may include one or more of a sorting apparatus 180, a preprocessing unit 172, a feeding device 174, a conveying chamber 182, a gas/solid separator 176, a gas cleanup unit 178, and/or other components.

The reactor 100 may be configured to pulverize and gasify materials such as municipal solid waste and/or other materials. Municipal solid waste may include a wide variety of materials. For example, municipal solid waste may include one or more of biodegradable waste including food and kitchen waste, green waste, paper, and/or other biodegradable waste; recyclable material including paper, glass, bottles, cans, metals, certain plastics, fabrics, clothes, batteries, and/or other recyclable material; inert waste including construction waste, demolition waste, dirt, rocks, debris, and/or other inert waste; electrical and electronic waste (WEEE) including electrical appliances, TVs, computers, screens, and/or other electrical and electronic waste; composite wastes including waste clothing, Tetra Packs, waste plastics such as toys; and/or other composite waste; hazardous waste including most paints, chemicals, light bulbs, fluorescent tubes, spray cans, fertilizer, containers, and/or other hazardous waste; toxic waste including pesticide, herbicides, fungicides, and/or other toxic waste; medical waste; and/or other municipal solid waste.

In some implementations, reactor 100 may be configured to receive preprocessed municipal solid waste from feeding device 106 and/or conveying chamber 182. Preprocessing unit 104, feeding device 106, and conveying chamber 182 are described further below.

Figure 2:
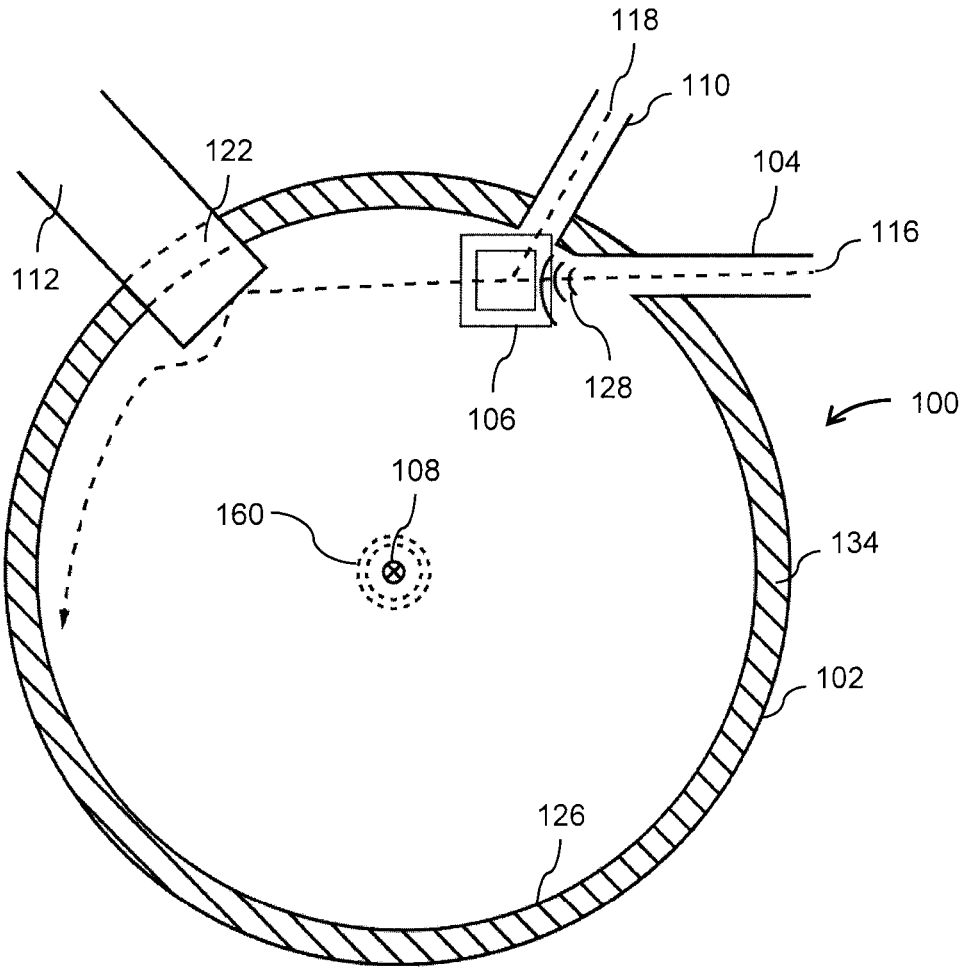
FIG. 2 illustrates a top view of a reactor, in accordance with one or more implementations.
Figure 3:
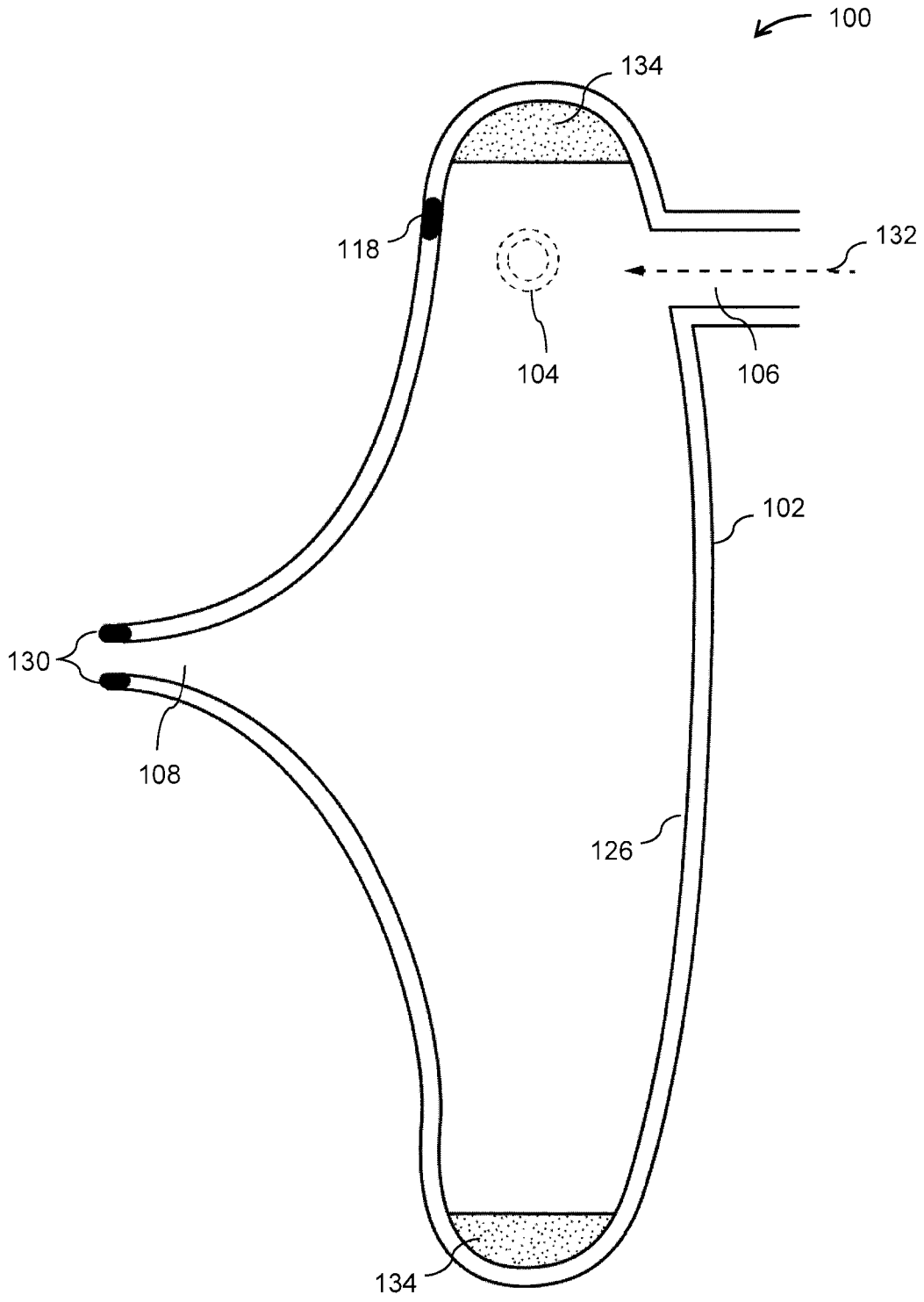
FIG. 3 illustrates a side view of the reactor, in accordance with one or more implementations.

FIGS. 2 and 3 illustrate a top and a side view of reactor 100, respectively, in accordance with one or more implementations. With continuous reference to FIGS. 2 and 3, reactor 100 will be described. As shown, reactor 100 may include one or more of a chamber 102, a first gas inlet 104, a material inlet 106, an outlet 108, a second gas inlet 110, a first replaceable wear part 112, and/or other components.

Chamber 102 may be configured to provide a volume in which material processing occurs. Chamber 102 may have a substantially circular cross-section centered on a longitudinal axis 124 that is normal to the cross-section. The substantially circular cross-section may facilitate the generation of a vortex rotating within chamber 102. A radius of the substantially circular cross-section of chamber 102 may continuously decrease at an end of chamber 102 proximal to outlet 108. The continuous decrease of the radius of the substantially circular cross-section of chamber 102 may be configured to cause an acceleration of a rotational speed of the gaseous vortex. As the continuous decrease of the radius of the substantially circular cross-section of chamber 102 may be shaped as a cone (illustrated in FIG. 3), a hemisphere, a horn-shape, and/or other shapes.

Chamber 102 may be formed of various materials. Chamber 102 may be formed of a rigid material. Chamber 102 may be formed of a thermally conductive material. Chamber 102 may be formed of an electrically conductive material. According to some implementations, chamber 102 may be formed wholly or partially of steel, iron, iron alloys, silicon carbide, partially stabilized zirconia (PSZ), fused alumina, tungsten carbide, boron nitride, carbides, nitrides, ceramics, silicates, geopolymers, metallic alloys, other alloys, and/or other materials. In some implementations, an internal surface 116 of chamber 102 may be coated with one or more coatings. An exemplary coating may be configured to prevent physical or chemical wear to internal surface 116 of chamber 102. In some implementations, a coating may be configured to promote a chemical reaction within chamber 102. An example of a coating that may promote a chemical reaction may include one or more of iron; nickel; ruthenium; rhodium; platinum; palladium; cobalt; other transition metals and their alloys, compounds, and/or oxides (e.g., the lanthanide series and their compounds, alloys, and/or oxides); and/or other materials.

The first gas inlet 104 may be configured to introduce a high-velocity stream of gas into chamber 102. The first gas inlet 104 may be positioned and arranged so as to generate a vortex of the stream of gas circulating within chamber 102. The vortex may rotate about longitudinal axis of chamber 102. The gas inlet may be positioned so that the gas stream 116 is directed substantially perpendicular to the longitudinal axis 124 of chamber 102. The first gas inlet 104 may be disposed so that the gas stream 116 is directed substantially tangential to a portion of the internal surface 126 of the substantially circular cross-section of chamber 102. The first gas inlet 104 may be positioned proximal to material inlet 106.

According to some implementations, the first gas inlet 104 may comprise an inlet gas nozzle (not depicted in this example) positioned within the first gas inlet 104. In those implementations, the inlet nozzle may be configured to accelerate the stream of gas being introduced into chamber 102, to introduce the stream of gas at a supersonic speed, thereby producing shockwaves in the stream of gas from inlet nozzle, and/or for any other purposes. Exemplary implementations of a gas inlet (e.g., first gas inlet 104) and/or an inlet nozzle are disclosed in U.S. patent application Ser. No. 14/298,868 filed on Jun. 6, 2014 and entitled "A REACTOR CONFIGURED TO FACILITATE CHEMICAL REACTIONS AND/OR COMMINUTION OF SOLID FEED MATERIALS" and U.S. patent application Ser. No. 14/298,877 filed on Jun. 6, 2014, and entitled "SYSTEMS AND METHODS FOR PROCESSING SOLID MATERIALS USING SHOCKWAVES PRODUCED IN A SUPERSONIC GASEOUS VORTEX," the disclosures of which are incorporated herein by reference in their entireties.

The gas stream 116 introduced by the first gas inlet 104 may include any number of gaseous materials. In some implementations, the gas may include a reduced gas, i.e., a gas with a low oxidation number (or high reduction), which is often hydrogen-rich. The gas may include one or more of steam, methane, ethane, propane, butane, pentane, ammonia, hydrogen, carbon monoxide, carbon dioxide, oxygen, nitrogen, chlorine, fluorine, ethene, hydrogen sulphide, acetylene, and/or other gases. The gas may be a vapor. The gas may be superheated. In some implementations, the gas may be heated beyond a critical point, and/or compressed above a critical pressure so that the gas becomes a superheated gas, compressible fluid, and/or a super critical fluid.

The material inlet 106 may be configured to introduce material 132 (illustrated in FIG. 3) to be processed into chamber 102. Material 132 may include biomass, municipal solid waste, and/or other materials. As shown, the material inlet 106 may be positioned proximal to the first gas inlet 104. The material inlet 106 may be positioned on a flat surface of chamber 102 that is perpendicular to longitudinal axis 124 of chamber 102. The material inlet 106 may be positioned so that material 132 introduced into chamber 102 is directed substantially parallel to longitudinal axis 124 of chamber 102. The material inlet 106 may be coupled to an auger (not depicted) that advances material through material inlet 106 into chamber 102.

Material 132 processed by reactor 100 may be processed by nonabrasive mechanisms facilitated by shockwaves 128 within chamber 102. For example, material 132 may be processed by tensile forces caused by shockwaves within chamber. Material 132 may be processed by cavitation in the stream of gas within chamber 102. As described below, material 132 may be processed in chamber 102 by direct impingement on the first replaceable part wear part 112. For example, material 132 may be fragmented by collision with the first replaceable part wear part 112. Material 132 may undergo a chemical transformation due to the catalytic effect built into the first replaceable part wear part 112, and/or due to the electric field imparted on the first replaceable part wear part 122.

The outlet 108 may be configured to discharge the gas and processed material from chamber 102. The outlet 108 may be positioned at an end of chamber 102 opposite to the first gas inlet 104 and material inlet 106. The outlet may be positioned on longitudinal axis 124 of chamber 102. As particle size of the processed material is reduced, those particles may migrate toward outlet 108. The outlet 108 may be coupled to a vacuum chamber (not depicted) configured to trap processed material discharged from outlet 108.

In some implementations, outlet 108 may include one or more of an outlet nozzle 130 (illustrated in FIG. 3) disposed within outlet 108. The outlet nozzle 130 may be configured to pressurize chamber 102. The outlet nozzle 130 may be configured to provide rapid cooling of processed material discharged from chamber 102. According to some implementations, such rapid cooling may reduce or minimize back reactions of metals, and/or other chemicals susceptible to back reactions. In some implementations, the outlet nozzle 130 may include a venturi tube (not depicted).

For resisting wear in reactor 100, at least one replaceable wear part 112 may be positioned at a first portion 122 of the inner surface 126 of chamber 102. The first portion 122 may be an area on the inner surface 126 where the stream 116, charged with pulverized particles from process material, contacts the surface 126. As such, the first portion 122 may be positioned opposite to the first gas inlet 104 within chamber 102. The at least one replaceable wear part 112 may be positioned at the first portion 122 to absorb impacts to first portion 122 on the inner surface 126 caused by the pulverized particles from the process material entrained by the gas stream 116 introduced by the first gas inlet 104. The at least one replaceable wear part 112 may be made of hard material such as tungsten carbide, titanium carbide, or titanium nitride, diamond, and/or any other materials for wear resistance. In some implementations, the at least one replaceable wear part 112 may have a polycrystalline diamond facing.

Figure 4:
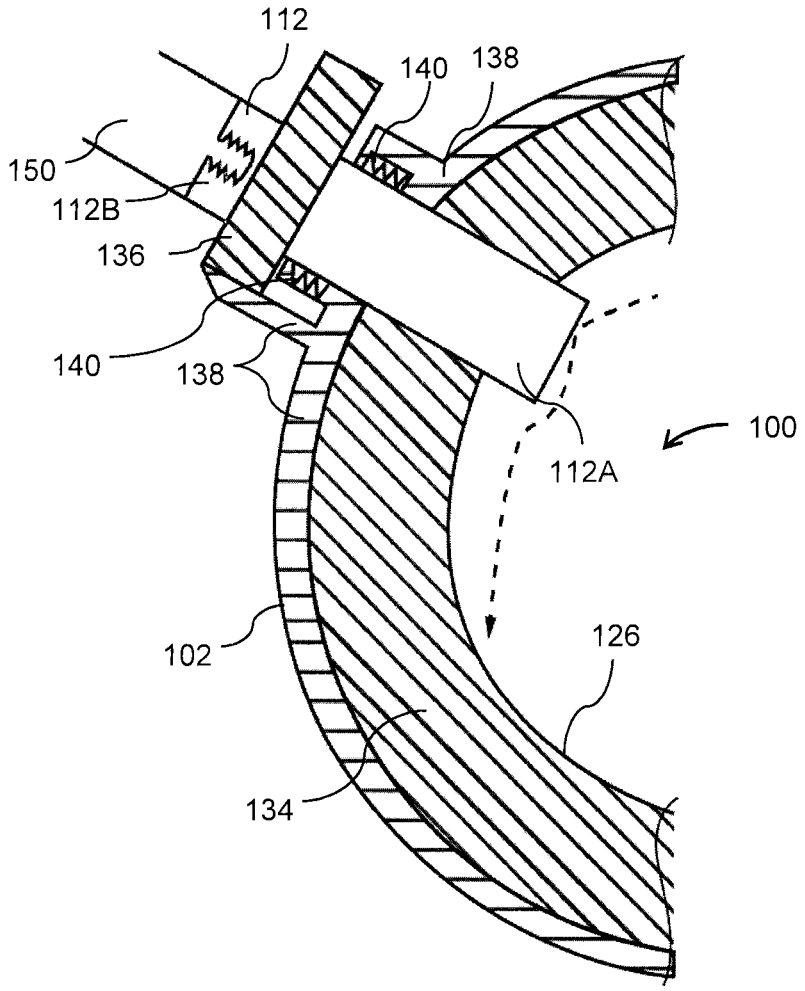
FIG. 4 illustrates one example of first replaceable wear part of the reactor shown in FIGS. 2 and 3 in a detailed view.

In some implementations, the at least one replaceable wear part 112 may be configured to continuously advance into the chamber as the surface of the contact end is worn. FIG. 4 illustrates one example of a the least one replaceable wear part 112 (or a "first replaceable wear part 112") in a detailed view. It will be described with reference to FIGS. 2 and 3. As shown in this example, the first replaceable wear part 112 may comprise a first end 112A, e.g., the contacting end of the first replaceable wear part 112, and a second end 112B that is opposite to the first end 112A. As shown, the first replaceable wear part 112 may comprise a thruster 136 configured to continuously feed the first replaceable wear part 112 into chamber 102 as the surface of the first replaceable wear part 112 is worn by the impacts caused by the pulverized particles from the process material entrained by the gas stream 116 introduced by the first gas inlet 104.

As also shown in this embodiment, a casing 138 may be configured to be positioned around chamber 102 and to serve as a support to the first replaceable wear part 112. Seals 140 may be positioned where the first replaceable wear part 112 enters chamber 102. Seals 140 may facilitate removal of the first replaceable wear part 112 for maintenance or replacement, which can reduce scheduled downtime, when compared to a conventional jet mill. As shown, a second replaceable wear part 150 may be coupled to the first replaceable wear part 112 at the second end 112B of the first replaceable wear part 112. This may facilitate continuous feeding of replaceable wear parts into chamber 102.

In some implementations, the first replaceable wear part 112 may comprise a rotatable cylindrical rod adapted to control impacts of the pulverized particles. In those implementations, the cylindrical rod may rotate about the axis of its cylinder when the pulverized particles contact the rod. The rotation of the rod may allow the wear to be controlled on the surface of the rod.

In some implementations, the contacting end of the first replaceable wear part 112 may be coated with catalyst material. The coating may be configured to protect the surface of the contacting end of the first replaceable wear part 112, and/or to promote a chemical reaction within chamber 102. For example, the catalyst material may be incorporated into the matrix of the first replaceable wear part 112 during manufacturing of the first replaceable wear part 112, such that at least a portion of the catalyst material is present on at least a first end 112A that is exposed to the interior of chamber 102. The catalyst material that may be coated on the contacting end of the first replaceable wear part 112, and/or incorporated into the matrix of the first replaceable wear part 112, may include one or more of platinum, palladium, and/or any other catalyst material for aiding the chemical reaction(s), and/or the comminution inside chamber 102. The coating on the first replaceable wear part 112 and/or the material incorporated into the matrix of the first replaceable wear part 112, may be configured such that the material ablates from the surface of the first replaceable wear part 112 at a rate that exposes a new surface of the first replaceable wear part 112. The ablated material may increase the throughput, and/or activity in chamber 102 by increasing the rate of reactions without a need to physically scale the size of reactor 100.

In some implementations, the first replaceable wear part 112 may be configured to be electronically isolated from chamber 102, and/or other components of reactor 100. This may facilitate an electrical field on the first replaceable wear part 112 having a variable voltage, amperage, frequency, waveform, and/or any other type(s) electrical potential to aid chemical reaction in chamber 102. In those implementations, the first replaceable wear part 112 may enable the Non-Faradaic Electrochemical Modification of Catalytic Activity (NEMCA), also known as Electrochemical Promotion of Catalysis (EPOC), for reducing energy required for comminution, and/or the chemical reactions inside chamber 102.

Returning again to FIGS. 2 and 3, in some implementations, reactor 100 may comprise a second gas inlet 110 for controlling the direction of the gas stream 116. As shown, the second gas inlet 110 may be arranged proximal to the first gas inlet 104. The second gas inlet 110 may comprise a nozzle configured to introduce a gas stream 118 to produce a "steering effect" to the gas stream 116. That is, the gas stream 118 may be introduced to control the direction of the first gas stream 116 such that the first gas stream 116 may be directed to a particular direction to even out wear in chamber 102. To achieve this, the second gas inlet 110 may be positioned such that the gas stream 118 may have an axial flow configured to intercept the gas stream 116 introduced by the first gas inlet 104.

As illustrated, the second gas inlet 110 may be employed to "steer" the gas stream 116 towards a desired area on the inner surface 126 of chamber 102. For example, without limitation, the second gas inlet 110 may be employed to steer the gas stream towards the first replaceable wear part 112 for limiting wear impact to the first replaceable wear part 112. In another example, the second gas inlet 118 may be disposed such that the gas stream 116 is directed to a second portion of the inner surface 126 of reactor 100 to even out wear inside chamber 102. In some implementations, gas stream 118 may be configured to introduce eddy current and interference currents into chamber 102 to vary the shock wave effects of reactor 100.

In some implementations, inner surface 126 of chamber 102 may comprise pockets (e.g., disruptors) around the periphery of the chamber 126. The pockets may be configured with appropriate sizes to receive some or all of the process material such that it is packed into the inner surface 126. FIG. 3 illustrates such pockets 134 on the inner surface 126 of chamber 102. The process material that is packed by the pockets may form a layer on the inner surface 126 to effect "material on material" wear resistance. That is, the process material packed into the pockets on the inner surface 126 may form a "new surface" of chamber 102 with the same hardness as the process material impacting the chamber 102.

Figure 5:
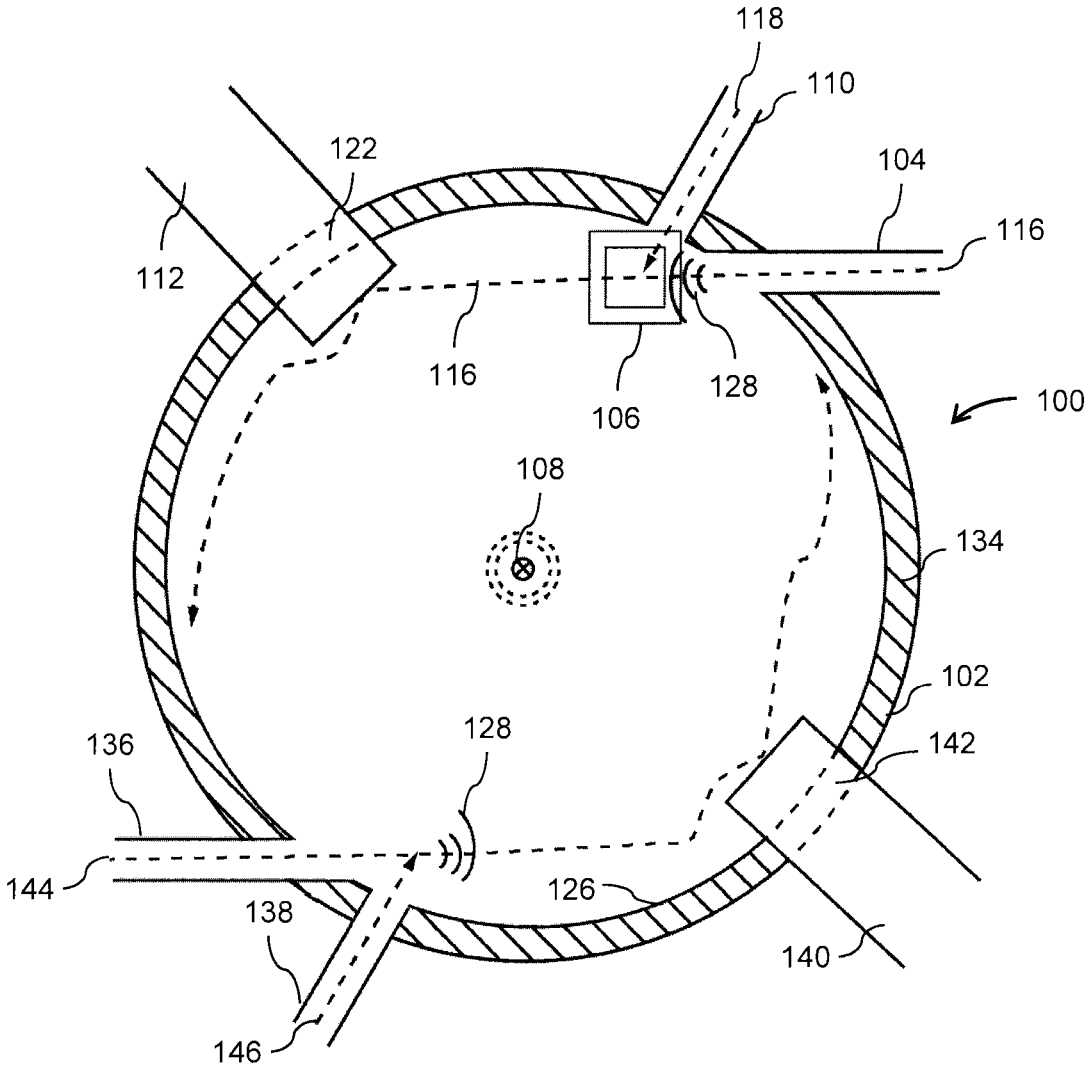
FIG. 5 illustrates one example of including multiple gas inlets and replaceable wear parts in the reactor shown in FIGS. 2 and 3.

In some implementations, additional gas inlets and replaceable wear parts may be included in reactor 100 to reduce and/or control effects caused by drag or boundary layers in reactor 100 as process material is required to travel a long flight path before existing. FIG. 5 illustrates one example of a reactor 100 configured with multiple gas inlets and replaceable wear parts. In addition to the first gas inlet 104, the second gas inlet 110 and the first replaceable wear part 112, reactor 100 may further comprise a third gas inlet 136, a fourth gas inlet 138, and a second replaceable wear part 140 arranged similarly to the arrangement of the first gas inlet 104, the second gas inlet 110 and the first replaceable wear part 112. That is, the fourth gas inlet 138 may be positioned proximal to the third gas inlet 136 such that gas stream 146 introduced by the fourth gas inlet 138 may "steer" the supersonic gas stream 144 introduced by the third gas inlet 136. As shown, the second replaceable wear part 140 may be positioned at a second portion 142 of inner surface 126 of chamber 102. The second portion 142 may be an area of inner surface 126 where gas stream 144, charged with pulverized particles from the process material, impacts the inner surface 126.

Figure 6:
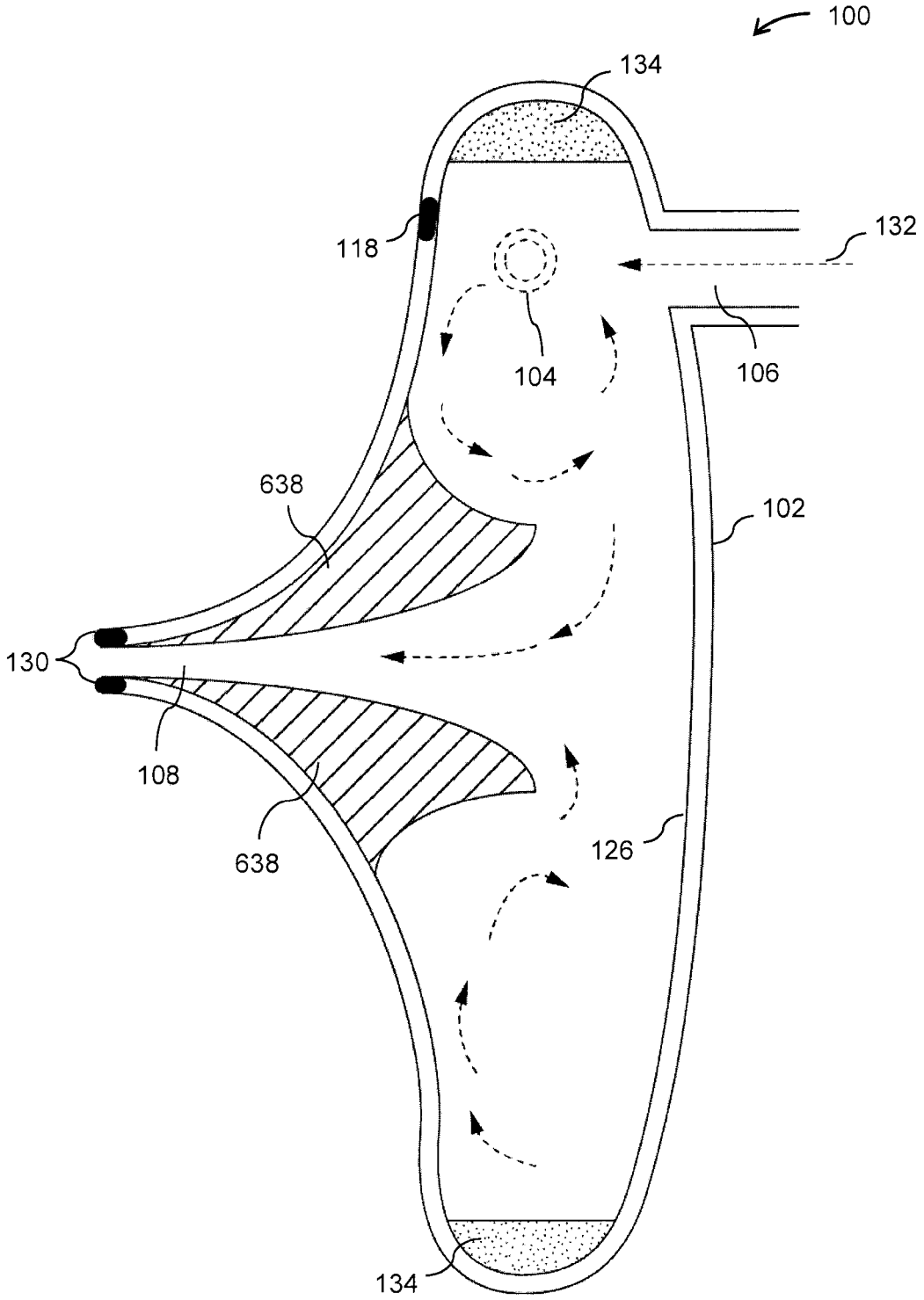
FIG. 6 illustrates one example of a shape of the interior volume of chamber designed to control the wear impact.

Returning to FIGS. 2 and 3, in some implementations, the shape of the interior volume of chamber 102 may be configured to control wear impact on desired areas within chamber 102. FIG. 6 illustrates one example of a shape of the interior volume of chamber 102 designed to control the wear impact. Reactor 100 may comprise casings 638 that may "partition" chamber 102 into multiple sections. In this embodiment, the casings 638 "partition" chamber 102 into sub-chambers in which a majority of the gaseous vortex takes place, as shown in FIG. 6. Designing the reactor 100 in this manner may help control the wear impact during the pulverization process in desired areas within chamber 102. Those having ordinary skill in the art will appreciate other designs within chamber 102 that would be suitable for controlling the wear impact, and to partition chamber 102 into multiple sections, using the guidelines provided herein.

Other components that may be included in reactor 100 may include, a heating component configured to provide heat to chamber 102, a ventilation component configured to vent gas from a region surrounding chamber 102, one or more sensors configured to provide a signal conveying information related to one or more parameters associated with reactor 100, and/or any other components. Exemplary implementations of reactor 100 and/or components of reactor 100 are disclosed in U.S. patent application Ser. No. 14/690,111 filed on Apr. 17, 2015 and entitled "PROVIDING WEAR RESISTANCE IN A REACTOR CONFIGURED TO FACILITATE CHEMICAL REACTIONS AND/OR COMMINUTION OF SOLID FEED MATERIALS USING SHOCKWAVES CREATED IN A SUPERSONIC GASEOUS VORTEX," the disclosure of which is incorporated herein by reference in its entirety.

Referring again to FIG. 1A, the preprocessing unit 172 may be configured to preprocess biomass and/or other material. Preprocessing biomass and/or other material may include physical preprocessing, and/or other preprocessing. Physical preprocessing may include removing one or more of gas bottles, heavy iron, steel, and/or other materials. Physical preprocessing may include a compression process whereby the material is squeezed at a pressure sufficient to remove a substantial proportion of embodied moisture. In some implementations, the embodied moisture may be reduced from about 80% to about 30%, or from about 70% to about 20%, or from about 60% to about 10%, or even further to less than 10%, or less than 8% or less than 5%.

Physical preprocessing may include one or more types of comminution in order to reduce the size of raw biomass and/or other materials. Comminution systems suitable for such size reduction may include one or more of a "Brentwood"-type shredder, a single drum shredder, a hammer mill, and/or other comminution systems. Physical preprocessing may include rendering the particles of biomass and/or other materials into a uniform size or substantially uniform size distribution. In some implementations, particles of uniform size may have diameters within the range of from about 1 to about 50 cm, or from about 1.5 to about 40 cm, or from about 2.5 to about 20 cm, or any value or range there-between. The preprocessing unit 172 may perform physical preprocessing by grinding, crushing, granulating, and/or other physical processes. The preprocessing unit 172 may include one or more of a twin roller shredder, a triple roller shredder, a hammer mill, and/or other preprocessing units.

The feeding device 174 may be configured to receive preprocessed biomass and/or other material from preprocessing unit 172. Generally speaking, the feeding device 174 may be configured to introduce preprocessed biomass and/or other material into a higher-pressure region from a lower-pressure region. The feeding device 174 may be configured to introduce preprocessed biomass and/or other material into reactor 100. In some implementations, feeding device 174 may include a lock hopper, a steam injector, a screw flight, a single or multiple reciprocating pistons. A lock hopper may incorporate a double pressure seal, thus enabling solids to be fed into a system with a higher pressure than the pressure existing in the solid's storage area. The steam injector may include or be similar to one which is typically used in boilers to inject water into the boiler. The screw flight may be sufficiently long to overcome back pressure. The single or multiple reciprocating pistons may be configured to ram the material into the device.

The gas/solid separator 176 may be configured to receive the dirty syngas from the reactor 100. Generally speaking, syngas, or synthesis gas, may be a fuel gas mixture including one or more of hydrogen, carbon monoxide, carbon dioxide, and/or other gases. Dirty syngas may be syngas that includes tars, biochar, and/or other contaminants.

The gas/solid separator 176 may be configured to separate a gas component and/or tars from the biochar of the dirty syngas. The gas/solid separator 176 may include one or more of a cyclone, a bag house, a spray tower, a venturi scrubber, a powered cyclone, a "hilsch" tube, and/or other devices. In some implementations, the gas component and/or tars may be fed back to the feeding device 174 so that the tars from the syngas condense on preprocessed biomass contained in the feeding device 174 and are reprocessed within the reactor 100. In some implementations, the gas component and/or tars may be fed back to the feeding device 174 via a heated conduit (not depicted) to prevent condensation of the tars prior to reaching the feeding device 174. The biochar may be outputted from the gas/solid separator 176.

The gas cleanup unit 178 may be configured to receive the gas component of the syngas from the feeding device 174. The gas component may be received after the tars have been condensed out in the feeding device 174. The gas cleanup unit 178 may be configured to clean the gas component. The gas cleanup unit 178 may clean the gas component of the syngas passed through the feeding device 174 by way of one or more of dust collection; a dry and wet process for removing gaseous pollutants; separating heavy metals; abating acid gases, dioxins and or furans; abating carbonyls and/or other related byproducts; and/or other processes for cleaning gas. The gas cleanup unit 178 may be configured to output clean gas.

FIG. 1B illustrates another embodiment of system 170 configured for gasifying municipal solid waste at low temperatures utilizing a reactor 100 designed to generate shockwaves in a supersonic gaseous vortex, in accordance with one or more implementations. The sorting apparatus 180 may be configured to remove metal components from the municipal solid waste. Metal components may include one or more of motors parts, LPG cylinders, and/or other metal components. The sorting apparatus 180 may be configured to remove one or more materials other than metal from the municipal solid waste. According to some implementations, municipal solid waste may be sorted by one or more of magnetic sorted, hand sorted, pneumatically sorting (e.g., in a zig zag device), winnowing, using "Whifley" tables or the like, using spiral vibrators, robotic sorting, and/or sorting by other techniques.

The preprocessing unit 172 may be configured to preprocess the sorted municipal solid waste. Preprocessing sorted municipal solid waste and/or other material may include physical preprocessing. Physical preprocessing may include removing gas bottles, heavy iron, steel, and/or other materials. Physical preprocessing may include a compression process whereby the material is squeezed at a pressure sufficient to remove a substantial proportion of the embodied moisture. In some implementations, the embodied moisture may be reduced from 60% to 10%. Physical preprocessing may include one or more types of comminution in order to reduce the size of raw sorted municipal solid waste and/or other materials. Comminution systems suitable for such size reduction may include, for example, one or more of a "Brentwood"-type shredders, single drum shredders, hammer mills and/or other comminution systems. Physical preprocessing may include making particles of sorted municipal solid waste and/or other materials a uniform size. In some implementations, particles of uniform size may have diameters of two inches, one inch, and/or other sizes. The preprocessing unit 172 may perform physical preprocessing by grinding, crushing, granulating, and/or other physical processes. The preprocessing unit 172 may include one or more of a twin roller shredder, a triple roller shredder, a hammer mill, and/or other preprocessing units.

The feeding device 174 may be configured to receive preprocessed municipal solid waste and/or other material from preprocessing unit 172. Generally speaking, the feeding device 174 may be configured to introduce preprocessed municipal solid waste and/or other material into a higher-pressure region from a lower-pressure region. The feeding device 174 may be configured to introduce preprocessed municipal solid waste and/or other material into conveying chamber 182. In some implementations, feeding device 174 may include a lock hopper, a steam injector, a screw flight, a single or multiple reciprocating pistons, and/or other devices. A lock hopper may incorporate a double pressure seal, thus enabling solids to be fed into a system with a higher pressure than the pressure existing in the solid's storage area. The steam injector may include or be similar to one that is typically used in boilers to inject water into the boiler. The screw flight may be sufficiently long to overcome back pressure. The single or multiple reciprocating pistons may be configured to ram the material into the device.

The conveying chamber 182 may be configured to introduce preprocessed municipal solid waste into reactor 100. The conveying chamber 182 may be pressurized with waste gas or process gas to a pressure compatible with the reactor 100. According to some implementations, this gas pressure may be arranged to stop steam from the process entering the feeding device 174 and condensing in the feed device 174. In the bottom of the conveying chamber 182, there may be a twin screw auger and/or other transporting mechanism configured to propel the preprocessed municipal solid waste directly into the reactor 100. In some implementations, conveying chamber 182 may be configured to preheat the preprocessed municipal solid waste prior to it being introduced into the reactor 100. It will be appreciated that, in some implementations, feeding device 174 and conveying chamber 182 may be combined as a singular unit.

The preprocessed municipal solid waste may be subjected to a very rapid heating as it enters the chamber of reactor 100. Because municipal solid waste is usually about 50% moisture, this sudden exposure to high temperature steam may result in the embodied water being converted to steam and thereby disrupting the material. Inside the reactor 100, preprocessed municipal solid waste may be subject to various forces that aid in the comminution of the material including one or more of ultrasonic pulses by the nozzle(s), disruptive forces as the steam transitions through the sound barrier, autogenous grinding, impact with the replaceable wear part(s), and/or other mechanisms. Such combined action may result in ultra-fragmentation of the municipal solid waste and the exposure of extremely high surface area in the municipal solid waste to steam in the reactor 100. The resulting high surface area may be in a condition where the municipal solid waste very rapidly reacts with the available steam and is converted predominately into hydrogen, carbon monoxide, and methane. Tests have been conducted using municipal solid waste. Almost complete conversion of the municipal solid waste into gas has been achieved at temperatures as low as 500 degrees Celsius and 250 kPa.

The gas/solid separator 176 may be configured to receive a mixture of product gas and ash from the reactor 100. The gas/solid separator 176 may be configured to separate out the ash from the product gas. The gas/solid separator 176 may include one or more of a cyclone, a bag house, a spray tower, a venturi scrubber, a powered cyclone, a "hilsch" tube and/or other devices. In some implementations, the product gas may be fed back to the feeding device 174 so that any tars from the product gas condense on preprocessed municipal solid waste contained in the feeding device 174 and are reprocessed within the reactor 100. In some implementations, the product gas may be fed back to the feeding device 174 via a heated conduit (not depicted) to prevent condensation of the tars prior to reaching the feeding device 174. The ash may be outputted from the gas/solid separator 176.

The gas cleanup unit 178 may be configured to receive product gas directly from the reactor 100 and/or from the feeding device 174. The product gas may be received after any tars have been condensed out in the feeding device 174. The gas cleanup unit 178 may be configured to clean the product gas. The gas cleanup unit 178 may clean the product gas by way of one or more of dust collection; a dry and wet processes for removing gaseous pollutants; separating heavy metals; abating acid gases, dioxins and/or furans; abating carbonyls and other related byproducts and/or other processes for cleaning gas. The gas cleanup unit 178 may be configured to output clean gas.

Figure 7:
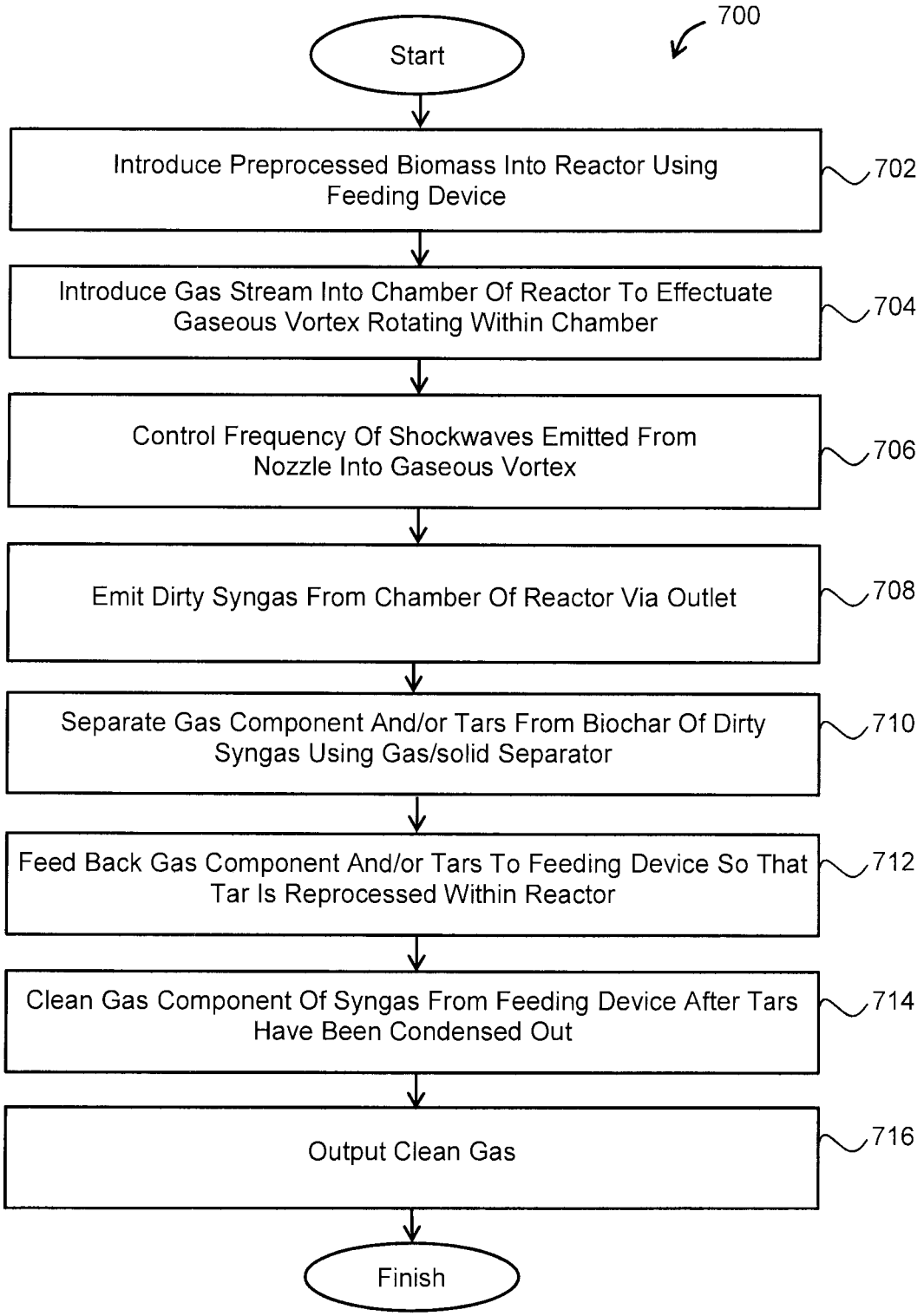
FIG. 7 illustrates a method for biomass gasification at low temperatures utilizing a reactor designed to generate shockwaves in a supersonic gaseous vortex, in accordance with one or more implementations.

FIG. 7 illustrates a method 700 for biomass gasification at low temperatures utilizing a reactor designed to generate shockwaves in a supersonic gaseous vortex, in accordance with one or more implementations. The operations of method 700 presented below are intended to be illustrative. In some implementations, method 700 may be accomplished with one or more additional operations not described, and/or without one or more of the operations discussed. Additionally, the order in which the operations of method 700 are illustrated in FIG. 7 and described below is not intended to be limiting.

At an operation 702, preprocessed biomass may be introduced using a feeding device (e.g., feeding device 106) into a reactor (e.g., reactor 102) configured to pulverize and gasify preprocessed biomass. The reactor may include a chamber having an internal surface that is substantially axially symmetrical about a longitudinal axis and a material inlet disposed at a first end of the chamber and configured to introduce biomass from the feeding device into the chamber.

At an operation 704, a gas stream may be introduced substantially tangentially to the inner surface of the chamber to generate a gaseous vortex rotating about the longitudinal axis within the chamber. The gas stream may be introduced via a gas inlet disposed proximate to the material inlet. The gas inlet may comprise a nozzle that accelerates the gas stream to a supersonic velocity.

At an operation 706, a frequency of shockwaves emitted from the nozzle into the gaseous vortex may be controlled. At an operation 708, dirty syngas may be discharged from the chamber of the reactor via an outlet disposed on the longitudinal axis at a second end of the chamber opposite from the first end. The dirty syngas may include a gas component, tars, and biochar. At an operation 710, the gas component and tars may be separated from the biochar of the dirty syngas using a gas/solid separator (e.g., gas/solid separator 108).

At an operation 712, the gas component and tars may be fed back to the feeding device so that the tars from the syngas condense on preprocessed biomass contained in the feeding device and are reprocessed within the reactor. At an operation 714, the gas component of the syngas from the feeding device may be cleaned after the tars have been condensed out in the feeding device. At an operation 716, clean gas may be outputted.

Figure 8:
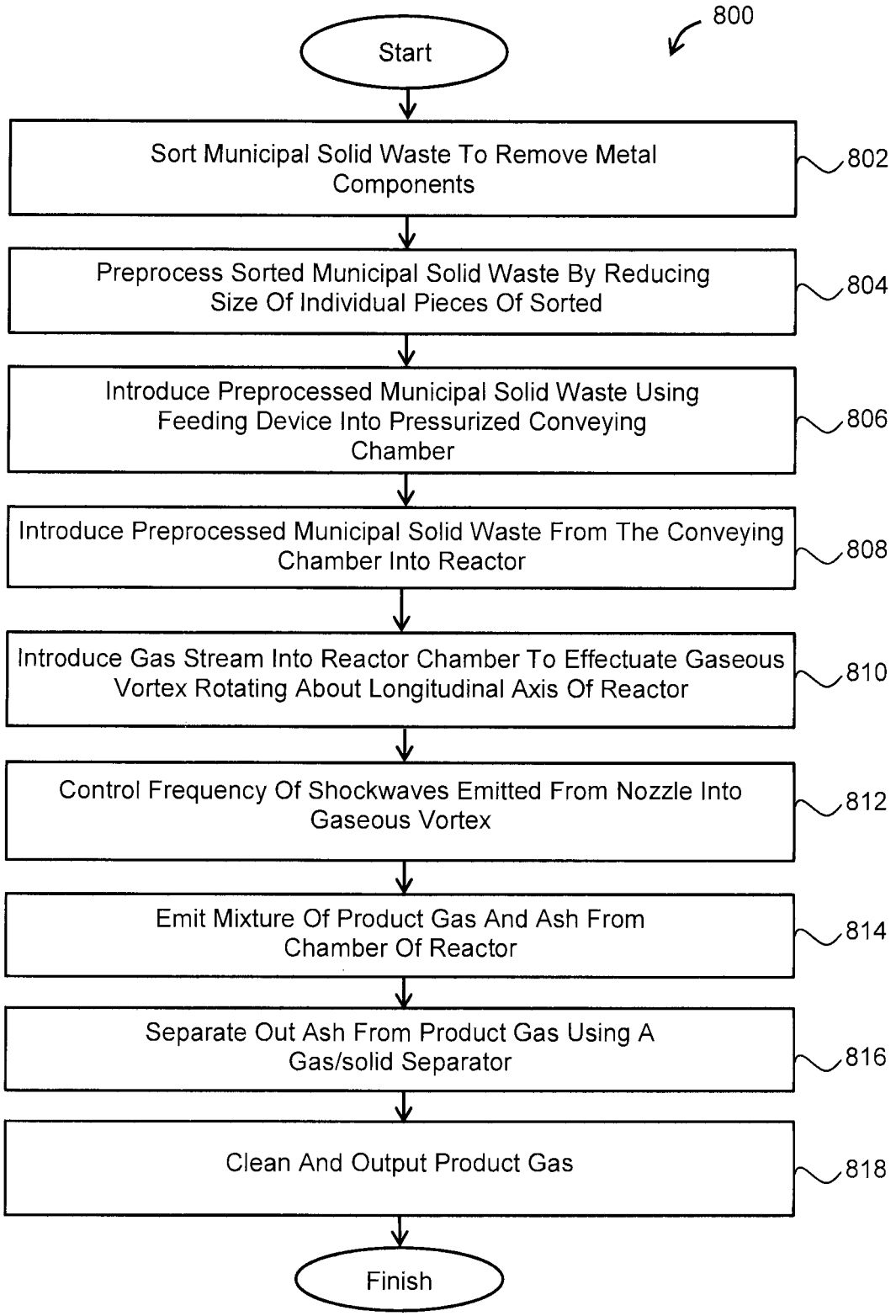
FIG. 8 illustrates a method for gasifying municipal solid waste at low temperatures utilizing a reactor designed to generate shockwaves in a supersonic gaseous vortex, in accordance with one or more implementations.

FIG. 8 illustrates a method 800 for gasifying municipal solid waste utilizing a reactor designed to generate shockwaves in a supersonic gaseous vortex, in accordance with one or more implementations. The operations of method 800 presented below are intended to be illustrative. In some implementations, method 800 may be accomplished with one or more additional operations not described, and/or without one or more of the operations discussed. Additionally, the order in which the operations of method 800 are illustrated in FIG. 8 and described below is not intended to be limiting.

At an operation 802, municipal solid waste may be sorted to remove metal components from the municipal solid waste. In some implementations, operation 802 may be performed by a sorting apparatus that is the same as or similar to sorting apparatus 180. At an operation 804, the sorted municipal solid waste may be preprocessed by reducing a size of individual pieces of the sorted municipal solid waste. In some implementations, operation 804 may be performed by a preprocessing unit that is the same as or similar to preprocessing unit 172.

At an operation 806, preprocessed municipal solid waste may be introduced using a feeding device (e.g., feeding device 174) into a conveying chamber (e.g., conveying chamber 182) pressurized with waste gas or process gas to a pressure compatible with a reactor (e.g., reactor 100). A compatible pressure may include a same pressure, a similar pressure, and/or other compatible pressures. At an operation 808, preprocessed municipal solid waste may be introduced from the conveying chamber into the reactor. The reactor may be configured to pulverize and gasify preprocessed municipal solid waste. The reactor may include a chamber having an internal surface that is substantially axially symmetrical about a longitudinal axis and a material inlet disposed at a first end of the chamber and configured to introduce municipal solid waste from the feeding device into the chamber.

At an operation 810, a gas stream may be introduced substantially tangentially to the inner surface of the chamber to effectuate a gaseous vortex rotating about the longitudinal axis within the chamber. The gas stream may be introduced via a gas inlet disposed proximate to the material inlet. The gas inlet may comprise a nozzle that accelerates the gas stream to a supersonic velocity. At an operation 812, a frequency of shockwaves emitted from the nozzle into the gaseous vortex may be controlled. At an operation 814, a mixture of product gas and ash may be emitted from the chamber of the reactor via an outlet disposed on the longitudinal axis at a second end of the chamber opposite from the first end. At an operation 816, the ash may be separated out from the product gas using a gas/solid separator (e.g., gas/solid separator 176). At an operation 818, the product gas may be cleaned and outputted.

An advantage of the system and method of the embodiments is the ability to process carbonaceous materials such as municipal waste, biomass, coal, soil, and other materials that may or may not contain contaminants at relatively low temperatures and pressures. For example, soil contaminated with polyaromatic hydrocarbons typically are processed at high temperatures (or using plasma), which may result in the production of dioxins. The systems and methods of the embodiments are capable of processing such contaminated soils at lower temperatures and pressures that avoid the production of dioxins. While not intending on being bound by any theory of operation, it is believed that the system and method uncouples long chain hydrocarbons and gasifies the hydrocarbons.

Example 1

Experimental results from carrying out the system and method depicted in FIG. 1B and described with reference to FIG. 8 have shown that even though the ash may contain undesirable heavy metal salts or oxides, those heavy metal salts or oxides have been rendered unleachable, and consequently can be either used as clean fill or deposited in a conventional landfill, without fear of leaching of the heavy metals. Because the reactor 100 is scalable across a wide range, it may be directly applicable to small, medium, or large factories as well as small and large communities in their waste disposal. The reactor 100 may not only eliminate many waste disposal problems but may provide gas for energy production. The byproduct ash has been determined by independent investigations to be non-leachable. This means that the ash is not considered a toxic waste even if it contains heavy metals, and that the ash can be disposed of in any conventional manner without the risk of leaching heavy metals into the water table.

Example 2

Experimental results from an exemplary implementation of the system and method depicted in FIG. 1A and described with reference to FIG. 7 are provided in TABLE 1 below. In the experiments, the gas stream introduced by a gas inlet 104 and/or 110 into the chamber 102 of the reactor 100 had a temperature ranging from 350° C. to 500° C. Complete gasification of the biomass was achieved with the gas stream introduced by the gas inlet 104 and/or 110 into the chamber 102 of the reactor 100 having a temperature of approximately 500° C. Thus, even with complete gasification, the gas stream introduced by the gas inlet 104 and/or 110 into the chamber 102 of the reactor 100 had a temperature that was low enough such that any glass contaminants in the biomass did not soften.

TABLE 1

Experimental results

| Run Temperature (° C.) | Feedstock | Result |
|---|---|---|
| 350 | Sawdust | Slight charring. Material dried. |
| 400 | Sawdust | Brown product. Short fibrous product, still of a woody nature. |
| 420 | Sawdust | Dark brown product. Still fibrous in nature. |
| 450 | Sawdust | Almost black char. No longer any woody appearance. |
| 500 | Sawdust | Complete gasification. |

Example 3

The systems and methods described herein (shown in FIGS. 1A, 1B, 7, and 8) were employed to treat a variety of carbonaceous materials. The results are summarized in Table 2 below:

TABLE 2

Experimental results

| Run Temperature (° C.) | Feedstock | Result |
|---|---|---|
| <550 | mix of wood, Polypropylene beads and water as a representation of MSW | 5% residual as ash of the input solid by weight |
| <550 | regular household waste (MSW Composition EU 27) | almost complete gasification and 25.8 MJ/m$^3$ heating value translating into 36 GJ/tonne due to its density |

TABLE 2-continued

Experimental results

| Run Temperature (° C.) | Feedstock | Result |
|---|---|---|
| <300 | Human bio solids | a fine grey ash as residue |
| 450 | a synthetic mix using of wood, cardboard and various mixed plastics | Complete gasification, delivered a similar result at 550° C. |
| 350 | Very toxic soil with a variety of poly aromatic hydrocarbons (PAH), 300 ppm poly chlorinated biphenyls (PCB's) as well as a significant variety of heavy metals | The heavy metals after processing had been rendered non-leachable with PCB levels of 300 ppm reduced to 0.4 ppm. This would enable residue being safely disposed of in a normal landfill or used as one of the main ingredients in concrete or in geopolymer. |
| <450 | Wet brown coal | Upgrading Victorian lignite in many conducted tests, reducing in particular the very high water and volatile levels of the lignite to products comparable with high quality steaming coal with a high calorific value (23.6 Net Wet CV), low ash and almost no sulfur, which could be transported (lignite to Sub-Bituminous Coal). The product should have excellent strength when made into briquettes. |
| 650 | Wet brown coal | towngas (>85% gasification at 650° C. well below the range of conventional gasifiers), with the residue as fine carbon powder |

Example 4

Victorian wet brown coal (low ash Loy Yang Coal) was processed using the system and method described herein. Two samples of the coal prior to processing were analyzed to determine the quality of the coal, as well as its composition. After processing with the system and method described herein, the same analysis was conducted on the processed coal after briquetting and charing. The results are shown in Tables 3, 4, and 5 below:

TABLE 3

| Sample | Moist % | Ash % | Volatile Matter % | Fixed Carbon % | C % | H % | N % | Sorganic % | Gross Dry CV MJ/kg | Gross Wet CV MJ/kg | Net Wet CV MJ/kg |
|---|---|---|---|---|---|---|---|---|---|---|---|
| LY Coal Batch 1 | 62.1 | 1.85 | 49.26 | 48.89 | 68.4 | 4.8 | 0.58 | 0.42 | 26.7 | 10.12 | 8.32 |
| LY Coal Batch 2 | 50.4 | 1.69 | 50.24 | 48.07 | 68.8 | 4.8 | 0.61 | 0.45 | 27.1 | 13.44 | 11.79 |
| Ex. | 9.82 | 2.27 | 48.36 | 49.37 | 70.7 | 4.7 | 0.7 | n.d. | 27.4 | 24.69 | 23.59 |
| Char from Ex. | 0.5 | 3.7 | 0.4 | 95.9 | 92.5 | 0.7 | 0.74 | n.d. | 32.7 | 32.5 | 32.35 |

TABLE 4

| dry ash free basis | | | | | | | | |
|---|---|---|---|---|---|---|---|---|
| Sample | Volatile Matter % | Fixed Carbon % | C % | H % | N % | Sorganic % | Stotal % | Gross Dry CV MJ/kg (ash free basis) |
| LY Coal Batch 1 | 50.19 | 49.81 | 69.69 | 4.9 | 0.59 | 0.43 | 0.43 | 27.2 |
| LY Coal Batch 2 | 51.10 | 48.90 | 69.98 | 4.9 | 0.62 | 0.46 | 0.49 | 27.6 |
| Ex. | 49.48 | 50.52 | 72.34 | 4.8 | 0.72 | — | 0.50 | 28.0 |
| Char from Ex. | 0.42 | 99.58 | 96.05 | 0.7 | 0.77 | — | 0.45 | 34.0 |

TABLE 5

| | Ash | Minerals (%) | | | | | Inorganics (%) | | | | | S total | Fe total |
|---|---|---|---|---|---|---|---|---|---|---|---|---|---|
| Sample | Yield % | $SiO_2$ | $Al_2O_3$ | $K_2O$ | $TiO_2$ | $FeS_2$ | Al | Fe | Ca | Mg | Na | (%) | (%) |
| Coal Batch 1 | 1.85 | 0.82 | 0.10 | 0.024 | 0.022 | 0.01 | 0.069 | 0.117 | 0.044 | 0.095 | 0.079 | 0.42 | 0.12 |
| Coal Batch 2 | 1.69 | 0.53 | 0.08 | 0.026 | 0.024 | 0.05 | 0.142 | 0.125 | 0.036 | 0.089 | 0.072 | 0.48 | 0.15 |
| Ex. | 2.27 | 0.81 | — | 0.009 | 0.014 | — | n.d. | n.d. | n.d. | n.d. | n.d. | 0.49 | 0.29 |

The above tables demonstrate the ability of the systems and methods of the embodiments described herein to upgrade low grade coal, and to produce a product having dramatically reduced levels of moisture and contaminants. The systems and methods operate at reduced temperatures (<450° C.) and pressures, and consequently, unexpectedly are capable of processing low grade coal to reduce contaminants in a safe and efficient manner.

Example 5

This example was conducted to determine the content of the gas from the system and method of the embodiments, when processing coal. The reactor temperature was modified during three (3) separate runs, from 400° C. in Run 1, to 550° C. in Run 2, to 700° C. in Run 3. The off-gas from the system was processed by using a primary conditioning step (impingers in an ice bath) to condense certain components such as moisture, tars, dust), and a secondary conditioning step to filter and cool the gas to remove other contaminants. The gas then was analyzed using a Testo 350 gas analyzer to measure the levels of CO, CO2, O2, SO2 and NOx at low concentrations, and a CAI ZRE gas analyzer to measure CO, CO2, O2 and CH4 at high concentrations. A conventional analyzer was used to measure hydrogen. The results are shown in Table 6 below.

TABLE 6

| | CO2 % vol | CO % vol | CH4 % vol | H2 % vol |
|---|---|---|---|---|
| Run 1 - 400° C. | 87.9 | 10.9 | 1.3 | — |
| Run 2 - 550° C. | 65.6 | 21.9 | 11.7 | 0.8 |
| Run 3 - 700° C. | 48.6 | 31.7 | 15.4 | 4.4 |

These test results demonstrate that the systems and methods can not only produce hydrogen and carbon monoxide, but also the fact that methane has been produced in our process directly from coal. Using the guidelines provided herein, a person having ordinary skill in the art will be capable of optimizing the process to produce much higher percentages of either methane or carbon monoxide and hydrogen.

Example 6

Soil containing polyaromatic hydrocarbons was processed in the system and method described herein at a temperature of about 350° C. The level of PCBs and dibutylchlorene were measured in the soil before processing, and then after three separate runs (examples A, B, and C) through the system described herein. The results (in mg/kg for PCBs, and in % for dibutylchlorene and moisture) are shown in Table 7 below.

TABLE 7

| Contaminant | Soil | Ex. A | Ex. B | Ex. C |
|---|---|---|---|---|
| | PCB type | | | |
| Aroclor - 1016 | <10 | <1 | <0.1 | <0.1 |
| Aroclor - 1221 | <10 | <1 | <0.1 | <0.1 |
| Aroclor - 1232 | <10 | <1 | <0.1 | <0.1 |
| Aroclor - 1242 | 300 | 24 | 4.9 | 4.6 |
| Aroclor - 1248 | <10 | <1 | <0.1 | <0.1 |
| Aroclor - 1254 | <10 | <1 | <0.1 | <0.1 |
| Aroclor - 1260 | <10 | <1 | <0.1 | <0.1 |
| Total PCB | 300 | 24 | 4.9 | 4.6 |
| Dibutylchlorene | 116 | 63 | 67 | 52 |
| Moisture | 2.3 | 0.9 | <0.1 | <0.1 |

The results show that the system and methods described herein are useful in reducing polyaromatic hydrocarbon contamination in soil by a significant amount, resulting in a reduction in total PCB of from about 75% to about 100%, or from about 80% to about 99%, or from about 90% to about 99%, or about 98%. The system and methods described herein can reduce the amount of PCB contamination to less than about 35 ppm, or to less than about 30 ppm, or to less than about 25 ppm, or less than about 15 ppm, or less than about 10 ppm, or less than about 5 ppm. The systems and methods described herein also are capable of reducing the dibutylchlorene content of contaminated soil by from about 40% to about 80%, or from about 40% to about 75%, or from about 45% to about 60%, and can reduce the moisture content of the soil by from about 35% to about 100%, or from about 50% to about 99.9%, or from about 60% to over 99%.

Although the present embodiments have been described in detail for the purpose of illustration based on what is currently considered to be the most practical and preferred implementations, it is to be understood that such detail is solely for that purpose and that the embodiments are not limited to the disclosed implementations, but, on the contrary, are intended to cover modifications and equivalent arrangements that are within the spirit and scope of the appended claims. For example, it is to be understood that the disclosed embodiments contemplate that, to the extent possible, one or more features of any implementation can be combined with one or more features of any other implementation.

What is claimed is:

1. A system configured for carbonaceous-containing material gasification at low temperatures utilizing a reactor designed to generate shockwaves in a supersonic gaseous vortex at a temperature of less than about 700° C., the system comprising:

a feeding device configured to introduce carbonaceous-containing material into a higher-pressure region from a lower-pressure region;

a reactor configured to pulverize and gasify carbonaceous-containing material received from the feeding device, the reactor including:

a chamber having an internal surface that is substantially axially symmetrical about a longitudinal axis;

a material inlet disposed at a first end of the chamber configured to introduce carbonaceous-containing material into the chamber;

a gas inlet disposed proximate to the material inlet and arranged to introduce a gas stream substantially tangentially to the internal surface of the chamber to generate a gaseous vortex rotating about the longitudinal axis within the chamber, the gas inlet comprising a nozzle that is configured to accelerate the gas stream to a supersonic velocity to thereby generate shockwaves in the stream of gas from the nozzle, the nozzle being configured to adjustably control a frequency of shockwaves emitted from the nozzle into the gaseous vortex and to introduce the gas stream to the chamber at a temperature of less than about 700° C.;

an outlet disposed on the longitudinal axis at a second end of the chamber substantially opposite the first end, the outlet configured to discharge processed material from the chamber, the processed material comprising at least a gas component and at least one solid component;

a gas/solid separator configured to receive the processed material from the reactor and separate the gas component and at least one solid component, and a gas cleanup unit configured to receive the gas component of the processed material, clean the gas component, and output clean gas.

2. The system of claim 1, wherein the carbonaceous-containing material is preprocessed biomass selected from the group consisting of wood, wood products, wood waste, paper, cardboard, cellulose-based materials, and mixtures thereof.

3. The system of claim 2, wherein the preprocessed biomass is contaminated with one or more of glass, stone, brick, ceramic material, or metals.

4. The system of claim 1, wherein the carbonaceous-containing material is municipal solid waste selected from the group consisting of biodegradable waste, recyclable material, inert waste, electrical and electronic waste, composite waste, hazardous waste, toxic waste, medical waste, and mixtures thereof.

5. The system of claim 1, wherein the frequency of the shockwaves is adjustable to optimize pulverization and/or gasification of the carbonaceous-containing material introduced into the chamber of the reactor.

6. The system of claim 1, wherein the reactor further includes a replaceable wear part configured to protect the inner surface of the chamber, the replaceable wear part being disposed within the chamber such that the gas stream and any carbonaceous-containing material carried by the gas stream impinge on the replaceable wear part as the gas stream is emitted from the gas inlet instead of impinging on the inner surface of the chamber.

7. The system of claim 6, wherein the replaceable wear part is fabricated from a material selected from the group consisting of tungsten carbide, titanium carbide, titanium nitride, diamond, and mixtures thereof.

8. The system of claim 6, wherein the replaceable wear part is comprised at least in part of a catalytic material.

9. The system of claim 8, wherein the catalytic material comprises one or both of platinum or palladium.

10. The system of claim 6, wherein the replaceable wear part is configured to be continuously fed into the chamber of the reactor during operation.

11. The system of claim 1, wherein the gas stream introduced by the gas inlet into the chamber of the reactor has a temperature of less than about 500° C.

12. The system of claim 11, wherein the system is configured to gasify the carbonaceous-containing material with the gas stream introduced by the gas inlet into the chamber of the reactor at a temperature of less than about 500° C.

13. The system of claim 1, wherein the gas stream introduced by the gas inlet into the chamber of the reactor has a temperature that is low enough such that any glass contaminants in the carbonaceous-containing material will not soften.

14. The system of claim 1, wherein the carbonaceous-containing material is biomass, wherein the outlet of the reactor is configured to discharge dirty syngas from the chamber, the dirty syngas including a gas component, tars, and biochar, wherein the gas/solid separator is configured to receive the dirty syngas from the reactor and separate the gas component and tars from the biochar of the dirty syngas, wherein the gas component and tars are fed back to the feeding device so that the tars from the syngas condense on preprocessed biomass contained in the feeding device and are reprocessed within the reactor; and wherein the gas cleanup unit is configured to receive the gas component of the syngas from the feeding device after the tars have been condensed out in the feeding device, the gas cleanup unit being further configured to clean the gas component and output clean gas.

15. The system of claim 14, wherein the gas component and tars are fed back to the feeding device via a heated conduit to prevent condensation of the tars prior to reaching the feeding device.

16. The system of claim 14, wherein the gas/solid separator is selected from the group consisting of a cyclone, a bag house, a spray tower, a venturi scrubber, or mixtures thereof.

17. The system of claim 14, wherein the biochar is outputted from the gas/solid separator.

18. The system of claim 14, wherein the gas cleanup unit cleans the gas component of the syngas passed through the feeding device by one or more processes selected from the group consisting of dust collection; a dry and wet process for removing gaseous pollutants; separating heavy metals; abating acid gases, dioxins and/or furans; abating carbonyls and/or other related byproducts, and mixtures thereof.

19. The system of claim 1, wherein the carbonaceous-containing material is municipal solid waste, wherein the system further comprises: (a) a sorting apparatus configured to facilitate sorting of municipal solid waste to remove metal components from the municipal solid waste; (b) a preprocessing unit configured to preprocess the sorted municipal solid waste by reducing a size of individual pieces of the sorted municipal solid waste; and (c) a conveying chamber configured to introduce preprocessed municipal solid waste into a reactor, the conveying chamber being pressurized with waste gas or process gas to a pressure compatible with the reactor, wherein the outlet of the reactor is configured to discharge a mixture of gas and ash from the reactor, wherein the gas/solid separator is configured to receive the gas and ash from the reactor and separate product gas from the ash, and wherein the gas cleanup unit is configured to receive the receive the product gas, clean the product gas and output clean gas.

20. The system of claim 19, wherein the product gas is fed back to the feeding device so that any tars in the product gas are condensed on preprocessed municipal solid waste contained in the feeding device and are reprocessed within the reactor.

21. The system of claim 20, wherein the product gas is fed back to the feeding device via a heated conduit to prevent condensation of any tars prior to reaching the feeding device.

22. The system of claim 19, wherein the gas/solid separator is selected from the group consisting of a cyclone, a bag house, a spray tower, a venturi scrubber, or mixtures thereof.

23. The system of claim 19, wherein the gas cleanup unit cleans the product gas by one or more processes selected from the group consisting of dust collection; a dry and wet process for removing gaseous pollutants; separating heavy metals; abating acid gases, dioxins and/or furans; abating carbonyls and/or other related byproducts, and mixtures thereof.

24. A method for waste gasification at low temperatures utilizing the system of claim 1, the method comprising:

introducing carbonaceous-containing material using a feeding device into a reactor;

introducing a gas stream at a temperature of less than about 700° C. substantially tangentially to the internal surface of the chamber to generate a gaseous vortex rotating about the longitudinal axis within the chamber, the gas stream being introduced via the gas inlet disposed proximate to the material inlet;

controlling a frequency of shockwaves emitted from the nozzle into the gaseous vortex;

discharging processed material from the chamber from of the reactor via the outlet;

separating the gas component and at least one solid component using the gas/solid separator;

cleaning the gas component; and outputting clean gas.

25. The method of claim 24, wherein the frequency of the shockwaves is controlled to optimize pulverization and/or gasification of the biomass introduced into the chamber of the reactor.

26. The method of claim 24, further comprising feeding a replaceable wear part into the chamber of the reactor, the replaceable wear part being configured to protect the inner surface of the chamber, the replaceable wear part being disposed such that the gas stream and any carbonaceous-containing material carried by the gas stream impinge on the replaceable wear part as the gas stream is emitted from the gas inlet instead of impinging on the inner surface of the chamber.

27. The method of claim 24, further comprising heating the gas stream to a temperature of less than about 700° C. prior to introducing the gas steam to the chamber of the reactor.

28. The method of claim 24, wherein the carbonaceous-containing material is biomass, and wherein the discharging, separating, and cleaning processes comprise:

discharging dirty syngas from the chamber of the reactor via the outlet disposed on the longitudinal axis at a second end of the chamber opposite from the first end, the dirty syngas including a gas component, tars, and biochar;

separating the gas component and tars from the biochar of the dirty syngas using the gas/solid separator;

feeding back the gas component and tars to the feeding device so that the tars from the syngas condense on preprocessed biomass contained in the feeding device and are reprocessed within the reactor; and cleaning the gas component of the syngas from the feeding device after the tars have been condensed out in the feeding device.

29. The method of claim 24, wherein the carbonaceous-containing material is biomass, and wherein the discharging, separating, and cleaning processes comprise:

discharging a mixture of product gas and ash from the chamber of the reactor via the outlet disposed on the longitudinal axis at a second end of the chamber opposite from the first end;

separating out the ash from the product gas using the gas/solid separator; and cleaning the product gas.

* * * * *